US010514234B2

(12) United States Patent
Sullivan

(10) Patent No.: US 10,514,234 B2
(45) Date of Patent: Dec. 24, 2019

(54) METHOD AND APPARATUS FOR IMPROVING THE AIM OF A WEAPON STATION, FIRING A POINT-DETONATING OR AN AIR-BURST PROJECTILE

(71) Applicant: NOSTROMO HOLDINGS, LLC, Alexandria, VA (US)

(72) Inventor: Kevin Michael Sullivan, Kennebunk, ME (US)

(73) Assignee: NOSTROMO HOLDINGS, LLC, Alexandria, VA (US)

( * ) Notice: Subject to any disclaimer, the term of this patent is extended or adjusted under 35 U.S.C. 154(b) by 0 days.

(21) Appl. No.: 15/860,792

(22) Filed: Jan. 3, 2018

(65) Prior Publication Data

US 2018/0231354 A1 Aug. 16, 2018

Related U.S. Application Data

(63) Continuation-in-part of application No. 15/200,023, filed on Jul. 1, 2016, now Pat. No. 9,879,963, which (Continued)

(51) Int. Cl.

| | |
|---|---|
| ***G06F 19/00*** | (2018.01) |
| ***F41G 3/14*** | (2006.01) |
| ***F41G 3/06*** | (2006.01) |
| ***F41G 3/02*** | (2006.01) |
| ***F42C 13/08*** | (2006.01) |
| ***F42C 13/02*** | (2006.01) |
| ***F42C 13/04*** | (2006.01) |

(Continued)

(52) U.S. Cl.

CPC ..... *F41G 3/142* (2013.01); *F41G 3/02* (2013.01); *F41G 3/06* (2013.01); *F41G 3/12* (2013.01); *F41G 3/22* (2013.01); *F42C 13/026* (2013.01); *F42C 13/047* (2013.01); *F42C 13/08* (2013.01); *F42B 12/20* (2013.01); *F42B 12/202* (2013.01)

(58) Field of Classification Search

CPC ... F41G 3/142; F41G 3/02; F41G 3/06; F42C 13/026; F42C 13/047; F42C 13/08; F42B 12/20; F42B 12/202

USPC ..... 235/404, 407, 411, 413, 414, 417

See application file for complete search history.

(56) References Cited

U.S. PATENT DOCUMENTS

| | | | |
|---|---|---|---|
| 3,019,073 | A | 1/1959 | Hall |
| 3,638,212 | A | 1/1972 | Cooper |

(Continued)

FOREIGN PATENT DOCUMENTS

| | | | |
|---|---|---|---|
| CA | 2082448 | C | 4/2002 |
| DE | 3603521 | A1 | 8/1987 |

(Continued)

*Primary Examiner* — Karl D Frech

(74) *Attorney, Agent, or Firm* — Robert W. Morris; Eckert Seamans Cherin & Mellott

(57) ABSTRACT

The method and apparatus for a remote weapon station or incorporated into manually-aimed weapons. The methodology requires use of a muzzle velocity sensor that refines the aiming of the second and subsequent fires or volleys fired from weapon systems. When firing the first volley a weapon uses an estimated velocity and, at firing, the muzzle velocity of a projectile is measured. When firing the second volley a weapon's fire control calculates an aiming point using the measured velocity of the first volley.

26 Claims, 24 Drawing Sheets

Related U.S. Application Data is a continuation-in-part of application No. 14/829,839, filed on Aug. 19, 2015, now Pat. No. 9,600,900, which is a continuation-in-part of application No. 14/227,054, filed on Mar. 27, 2014, now abandoned.

(60) Provisional application No. 61/805,534, filed on Mar. 27, 2013.

(51) Int. Cl.

| | |
|---|---|
| ***F41G 3/12*** | (2006.01) |
| ***F41G 3/22*** | (2006.01) |
| *F42B 12/20* | (2006.01) |

(56) References Cited

U.S. PATENT DOCUMENTS

| | | | | |
|---|---|---|---|---|
| 3,659,201 | A | 4/1972 | Vogelsang | |
| 4,226,397 | A | 10/1980 | Schmidt | |
| 4,342,961 | A | 8/1982 | Zimmermann et al. | |
| 4,483,190 | A | 11/1984 | Cornett | |
| 4,486,710 | A | 12/1984 | Schmidt | |
| 4,524,323 | A | 6/1985 | Schmidt | |
| 4,677,376 | A | 6/1987 | Ettel et al. | |
| 4,818,104 | A | 4/1989 | Hartman | |
| 4,862,785 | A | 9/1989 | Ettel et al. | |
| 4,864,515 | A | 9/1989 | Deck | |
| 4,928,523 | A | 5/1990 | Muhrer et al. | |
| 5,026,158 | A | 6/1991 | Golubic | F41G 1/38 356/252 |
| 5,159,396 | A | 10/1992 | Yuhas | |
| 5,233,901 | A | 8/1993 | Nilsson et al. | |
| 5,267,502 | A | 12/1993 | Gent et al. | |
| 5,685,504 | A | 11/1997 | Schneider et al. | |
| 5,814,756 | A | 9/1998 | Boss | |
| 5,827,958 | A | 10/1998 | Sigler | |
| 5,834,675 | A | 11/1998 | Boss | |
| 6,138,547 | A | 10/2000 | Larsson et al. | |
| 6,170,377 | B1 | 1/2001 | Larsson et al. | |
| 6,216,595 | B1 | 4/2001 | Lamorlette et al. | |
| 6,615,739 | B2 | 9/2003 | Gibson et al. | |
| 6,644,111 | B2 | 11/2003 | Cytron et al. | |
| 6,666,089 | B2 | 12/2003 | Dilz, Jr. | |
| 6,752,137 | B2 | 6/2004 | Brunette et al. | |
| 6,898,971 | B2 | 5/2005 | Dilz, Jr. | |
| 8,074,555 | B1 | 12/2011 | Sullivan et al. | |
| 8,286,872 | B2 | 10/2012 | Laupstad et al. | |
| 8,305,071 | B2 | 11/2012 | Frick | |
| 8,499,693 | B2 | 8/2013 | Sullivan et al. | |
| 9,600,900 | B2 | 3/2017 | Sullivan | |
| 2005/0126379 | A1 | 6/2005 | Pikus et al. | |
| 2005/0126380 | A1* | 6/2005 | Ettmuller | F42C 17/04 89/6.5 |
| 2005/0241203 | A1 | 11/2005 | Lizotte | F41A 21/12 42/1.01 |
| 2009/0289619 | A1 | 11/2009 | Frick | |
| 2011/0297742 | A1 | 12/2011 | Sullivan et al. | |
| 2012/0085162 | A1 | 4/2012 | Furch et al. | |
| 2012/0125092 | A1* | 5/2012 | Downing | G01L 5/14 73/167 |
| 2014/0007760 | A1* | 1/2014 | Frick | F41A 21/32 89/6.5 |
| 2014/0060298 | A1* | 3/2014 | Mueller | F42C 11/065 89/6.5 |

FOREIGN PATENT DOCUMENTS

| | | | |
|---|---|---|---|
| DE | 19719977 | C1 | 10/1998 |
| EP | 0108973 | B1 | 1/1987 |
| WO | 2008048116 | A1 | 4/2008 |
| WO | 2010108917 | A1 | 9/2010 |
| WO | 2012131548 | A1 | 10/2012 |

* cited by examiner

Modeling 40mm x 53 Uncorrected Volleys

| Mean Lot Muzzle Velocity | Average Miss Distance (Impact Point) | Adjusted Miss Distance (5 meter lethal Radius) |
|---|---|---|
| 237 meters / second | 24 meters | 19 meters |
| 238 meters / second | 18 meters | 14 meters |
| 239 meters / second | 10 meters | 6 meters |

Figure 1H

| Valley 2 | Elevation Angle $\phi_n$ | | Computation | Elevation Solution |
|---|---|---|---|---|
| | [°] | [MILS] | | |
| MV Based | 7.375 | 131.127 | 12D | 22D |
| Difference | 0.282 | 5.004 | | |

METHOD AND APPARATUS FOR IMPROVING THE AIM OF A WEAPON STATION, FIRING A POINT-DETONATING OR AN AIR-BURST PROJECTILE

CROSS-REFERENCE TO RELATED APPLICATIONS

This application is a continuation-in-part of U.S. patent application Ser. No. 15/200,023, filed Jul. 1, 2016 (published as U.S. 2017/0097216), which application, in turn, is a continuation-in-part of U.S. patent application Ser. No. 14/829,839, filed Aug. 19, 2015 (published as U.S. 2016/0055652 and now U.S. Pat. No. 9,600,900), which application, in turn, is a continuation-in-part of U.S. application Ser. No. 14/227,054, filed Mar. 27, 2014 (published as U.S. 2016/0252335 and now abandoned) which, in turn, claims priority from the U.S. Provisional Application No. 61/805,534 filed Mar. 27, 2013. The present application claims priority from all of the aforementioned patent applications and from the Provisional Application No. 61/805,534 filed Mar. 27, 2013.

To the extent permitted by law, the disclosures of the aforementioned patent and patent applications are incorporated herein by reference. The disclosure of U.S. Pat. No. 8,286,872 is also incorporated herein by reference.

BACKGROUND OF THE INVENTION

The present invention relates to military fire control systems generally and, more specifically, to a system for adjusting the elevation and traverse of the gun barrel in a weapon station in dependence upon certain parameters, such as the measured muzzle velocity of a previously fired munition.

Remote Weapon Station:

By way of background, it is useful to consider the presently existing methods and systems of firing programmable ammunition from a so-called "remote weapon station" ("RWS"). When firing conventional ammunition an RWS Operator (1) ranges the target to ascertain the target range, and (2) elevates the barrel of the weapon to align reticules (whereupon the fire control computer identifies the elevation and deflection offsets using range tables or standard ballistic computation in an algorithm). The RWS Operator then (3) fires the first volley and (4) manually adjusts for subsequent (2-6) volleys, making adjustments (for that same target) based on the actual observed impact of the ammunition. When firing air-burst ammunition, the current practice requires the RWS Operator to (1) laze the target to ascertain the range, (2) elevate the weapon to align reticules (whereupon the fire control computer identifies the elevation, deflection offsets and a calculated air-burst time, corresponding to a standard muzzle velocity using range tables or standard ballistic computation in an algorithm). The RWS Operator then (3) fires the first volley and the gunner (4) manually adjusts the aim (for that same target), firing subsequent (2-6) volleys while making adjustments based on the actual observed impact of the ammunition.

SUMMARY OF THE INVENTION

A principal objective of the present invention is to provide both a method or operating a weapon station and a manually-controlled weapon station configuration to improve the precision delivery of both conventional and programmable munition projectiles.

The present invention provides an efficient method and weapon configuration where the muzzle velocity of a first volley is measured and the elevation to fire the second volley is automatically adjusted. This adjustment is coupled with the measurement of muzzle velocity and a programming technology, as is fully disclosed in the U.S. Pat. No. 9,600,900.

According to the present invention, the remote weapon station ("RWS") system is modified to fire both conventional and air-burst cartridges as herein set forth. When firing conventional ammunition, the RWS Operator (1) lazes the target to ascertain the range, and (2) elevates the weapon to align reticules (the fire control computer identifies the elevation and deflection offsets using range tables or standard ballistic computation in an algorithm). The RWS Operator then (3) fires the first volley and the RWS system (4) automatically adjusts the elevation for second and subsequent volleys (at that same target) using the computed average muzzle velocity of the fired volleys. When firing programmable air-burst ammunition the RWS Operator (1) lazes the target to ascertain the range, and (2) elevates the weapon to align reticules (the fire control computer identifies the elevation, deflection offsets and a calculated air-burst time corresponding to a standard muzzle velocity using range tables or standard ballistic computation in an algorithm). The RWS Operator then (3) fires the first volley of ABM ammunition using the expected flight time and the RWS system (4) automatically adjusts both the elevation and air-burst time of flight for second and subsequent volleys (at that same target) using the computed average muzzle velocity of the fired volleys.

RWS systems fire belted ammunition that is packaged into ammunition cans and placed in remote weapon stations. The operator has the choice to select different cartridges, as each type of cartridge in a military's inventory has unique external ballistics. When a can of ammunition is expended, the spent can is removed and replaced with a new can of ammunition. Each ammunition can houses ammunition cartridges derived from a single production lot of ammunition. Realizing that the variation of ammunition velocity, within an ammunition lot, has a narrower variation that the variation of ammunition lot to lot, the method of using the pre-set default muzzle velocity data for a $1^{st}$ volley from an ammunition can, and adjusting the $2^{nd}$ volley based on the actual measured muzzle velocity of the $1^{st}$ volley, provides for a practical means to improve the aim and terminal effect of ammunition.

Ammunition Programming Technologies:

It is also useful to understand projectile programming technologies that may be coupled to remote weapon stations and manually controlled weapon systems. The first air-burst technologies fielded by the Oerlikon and Bofors companies appeared in the late 1980s. Oerlikon's U.S. patents include U.S. Pat. Nos. 4,862,785; 5,814,756, and 5,834,675 describing what has been marketed as the AHEAD system. The disadvantage of using the "Oerlikon AHEAD" technique is that it consumes a great deal of power with each shot because the programming coils used in this technique are bulky and heavy.

To overcome this disadvantage, Bofors introduced the Programmable Barrel Weapon technology as disclosed in U.S. Pat. No. 6,138,547 and this programming technology was incorporated into the US MK47 weapon system produced by GDOTS in Saco, Me. The published patent application US 2005/0126379 discloses RF data communication link for setting electronic fuzes. Whereas the programming of the projectile is only limited to pre-launch programming, the technique does not provide a method to program an in-flight projectile.

U.S. Pat. No. 6,216,595 discloses a process for the in-flight programming of the trigger time for a projectile element. The trigger time is transmitted via radio frequency signals which, unfortunately, admit to several disadvantages to effective transmission, such as interference from IED suppression technology. U.S. Pat. No. 6,170,377 to Bofors discloses a method and apparatus for transmission of programming data to the time fuze of a projectile via an inductive transmission coil. However, in the case of Oerlikon AHEAD, the inductive coils are very bulky and heavy. U.S. Pat. No. 6,138,547 discloses a method and system for programming fuzes using electric programming pulses to transmit data between a programmable fuze and a programming device. Due to oscillation of the projectile, it is difficult to maintain consistent contact or proximity between the external source of the programmed pulses and the conductor located on the projectile. Also, these various systems require extensive modification of the weapon design which limits their use. As the cost of power sources and the power consumption of electronics has dropped over time, a cost-effective approach to post-shot programming has become more practical.

For example, U.S. Pat. No. 8,499,693 describes a system for optically programming ammunition; this system has been incorporated into the German Army DM131 cartridge. Around the same time period, NAMMO introduced its radio programmed fuze.

The present invention provides a practical method and apparatus for improving the aim of both: (1) a remote weapon station or (2) configuration manually elevating a weapon, with hand held range finder, firing either conventional point-detonation ammunition cartridges or programmable air-burst munitions.

According to the invention, where a ballistic calculator in a fire control unit uses a pre-set default muzzle velocity ("MV") for a first shot or first volley fired from a given package or can of ammunition, the method comprises:

(a) determining and inputting to the ballistic calculator a range to the target;

(b) adjusting a barrel elevation by means of the ballistic calculator based on (1) the default MV for a projectile from the package or ammunition can and (2) the range to the target for a ballistic flight of the projectile toward the target;

(c) firing at least one projectile from the package or ammunition can toward the target;

(d) measuring an actual MV for the fired projectile(s) with a sensing device;

(e) adjusting the barrel elevation by means of the ballistic calculator based on the actual MV data measured by the sensing device and the range to the target: and (f) firing additional projectiles from the ammunition can toward a target.

Steps (e) through (f) are then repeated as often as desired.

The ammunition projectiles are retrieved, as needed, from an ammunition can stored on the remote weapon station. The projectiles in the can are conventionally linked together in a chain.

When a new can of ammunition is placed in use, the entire method is repeated, with the fire control's ballistic calculator setting a first fire control solution, a first elevation, using default muzzle velocity settings for each new can of ammunition.

According to a first preferred embodiment of the invention, the programmable air-burst projectiles have an optical sensor or modem that receives optical programming signals emitted from a transmitter electronically connected to, and physically adjacent to, the weapon station.

According to a second preferred embodiment of the invention, the programmable air-burst projectiles have an RF antenna that receives RF signals emitted from a transmitter electronically connected to, and physically adjacent to, the weapon station.

According to a third preferred embodiment of the invention, the programmable air-burst projectiles have a magnetic sensor that receives modulated electro-magnetic transmissions emitted from a magnetic modulating programmer electronically connected to, and physically adjacent to, the weapon station.

According to a fourth preferred embodiment of the invention, the programmable air-burst projectiles have an antenna that receives microwave band electro-magnetic transmissions emitted from a focused microwave programmer electronically connected to, and physically adjacent to, the weapon station.

The weapon station for carrying out the method according to the invention preferably comprises a weapon having a barrel with a muzzle and capable of firing ammunition projectiles from a common manufactured lot, preferably linked ammunition projectiles from an ammunition can; a mechanical support for the weapon configured for movement of the barrel in the elevation and azimuth directions; a sensing device disposed in or adjacent the weapon barrel for measuring the muzzle exit velocity (MV) of the fired projectiles; and a fire control unit, coupled to the MV sensing device and to the mechanical support, for controlling the movement of the weapon barrel.

The fire control unit includes a processor, responsive to a first input that receives a range of a desired target and a second input that receives an MV of an ammunition projectile, to calculate and produce an output to the mechanical support for setting the elevation of the weapon barrel prior to firing a projectile. The second input is configured to receive initially a default muzzle velocity for the ammunition projectiles, e.g., a linked chain of projectiles, from the ammunition can and, thereafter, post-shot of an initial firing such projectile(s), to receive an actual measured MV from said MV sensing device.

In a preferred embodiment of the invention, the fire control processor is operative to calculate a new setting for the weapon barrel elevation after the MV of an initial projectile volley is measured, thereby improving the aiming fidelity of the weapon.

Advantageously, the fire control processor is further operative to calculate a new setting of the weapon barrel elevation after the MV of each further projectile volley is measured, thereby to produce finer adjustments in the barrel elevation and thus continuously improve aiming precision for subsequent volleys.

Where a can of linked ammunition projectiles are programmable air-burst projectiles, the fire control processor is further operative to calculate a new setting of the weapon barrel elevation after the MV of each further projectile volley is measured, and to record a histogram of projectile MV's. The fire control processor uses the recorded histogram to continuously improve the elevation precision and the emitted projectile programming signal for the time of flight or burst of the projectile, to thereby improve the burst accuracy of second and subsequent projectile volleys.

In a preferred embodiment of the invention, the fire control processor adjusts the weapon barrel elevation for a terrestrial target to detonate the projectiles in the range of 1-3 meters above the desired target.

In a still further embodiment of the invention, a hand-held optical aiming device is used for determining the range to the desired target and for transmitting the range to the first input of said fire control unit.

For a full understanding of the present invention, reference should now be made to the following detailed description of the preferred embodiments of the invention as illustrated in the accompanying drawings.

BRIEF DESCRIPTION OF THE DRAWINGS

FIG. 1H shows modeling results for 40 mm×53 uncorrected volleys.

DETAILED DESCRIPTION OF THE PREFERRED EMBODIMENTS

Figure 1A:
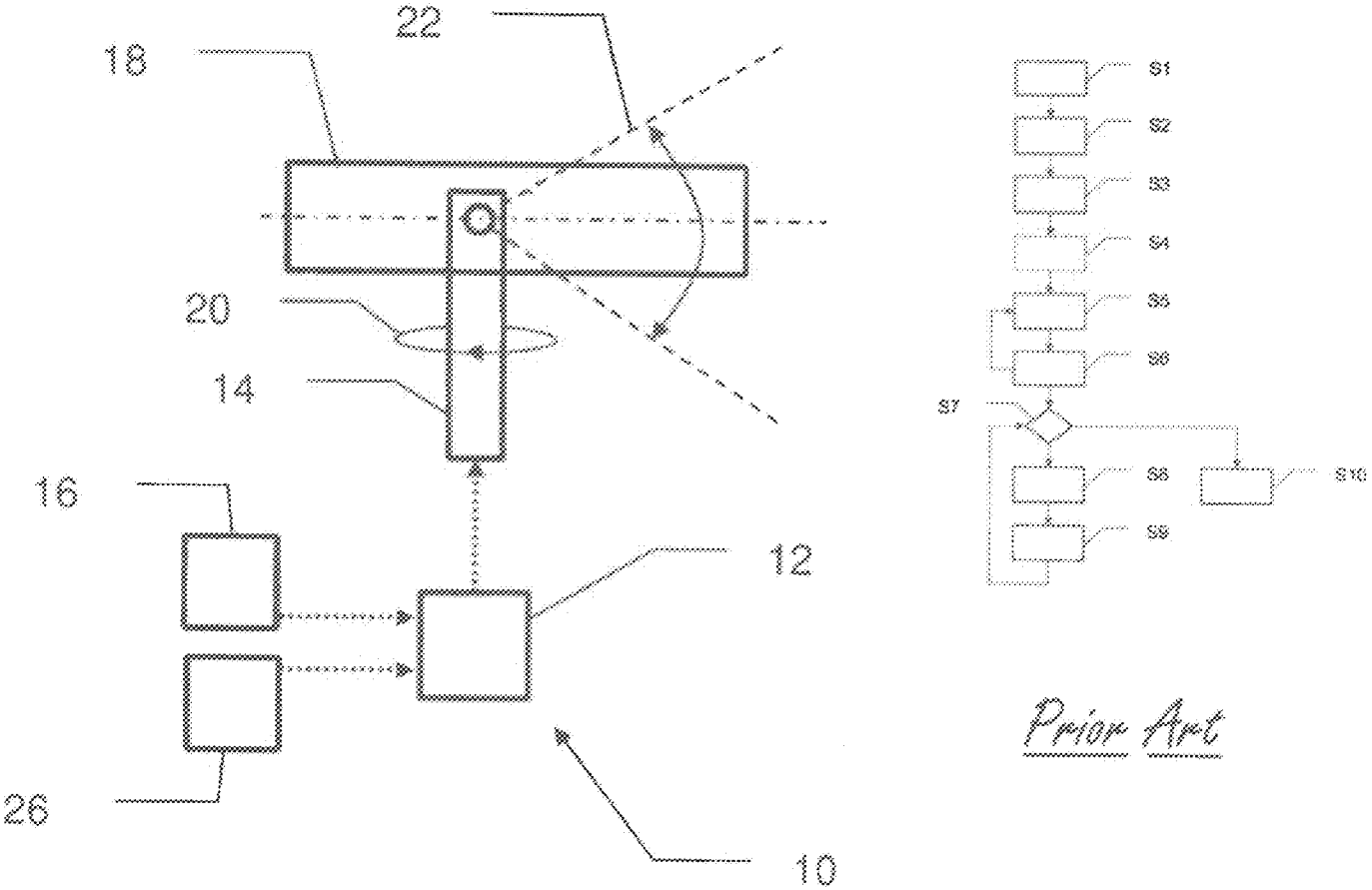
FIG. 1A depicts a system diagram and function sequence for a prior Art Kongsberg Remote Weapon Station (RWS).

The relevant prior art as well as the preferred embodiments of the present invention will now be described with reference to FIGS. 1A-4F of the drawings. Identical elements are designated with the same reference numerals.

Prior Art

For context and for an understanding of the present state of the art, it is useful to examine the existing remote weapon station configurations to illuminate how lot-to-lot variation of mean muzzle velocity in 40 mm cartridges influences calculated aiming solutions. FIGS. 1A-1F depict benchmarks and performance characteristics delivered in existing systems.

Figure 1B:
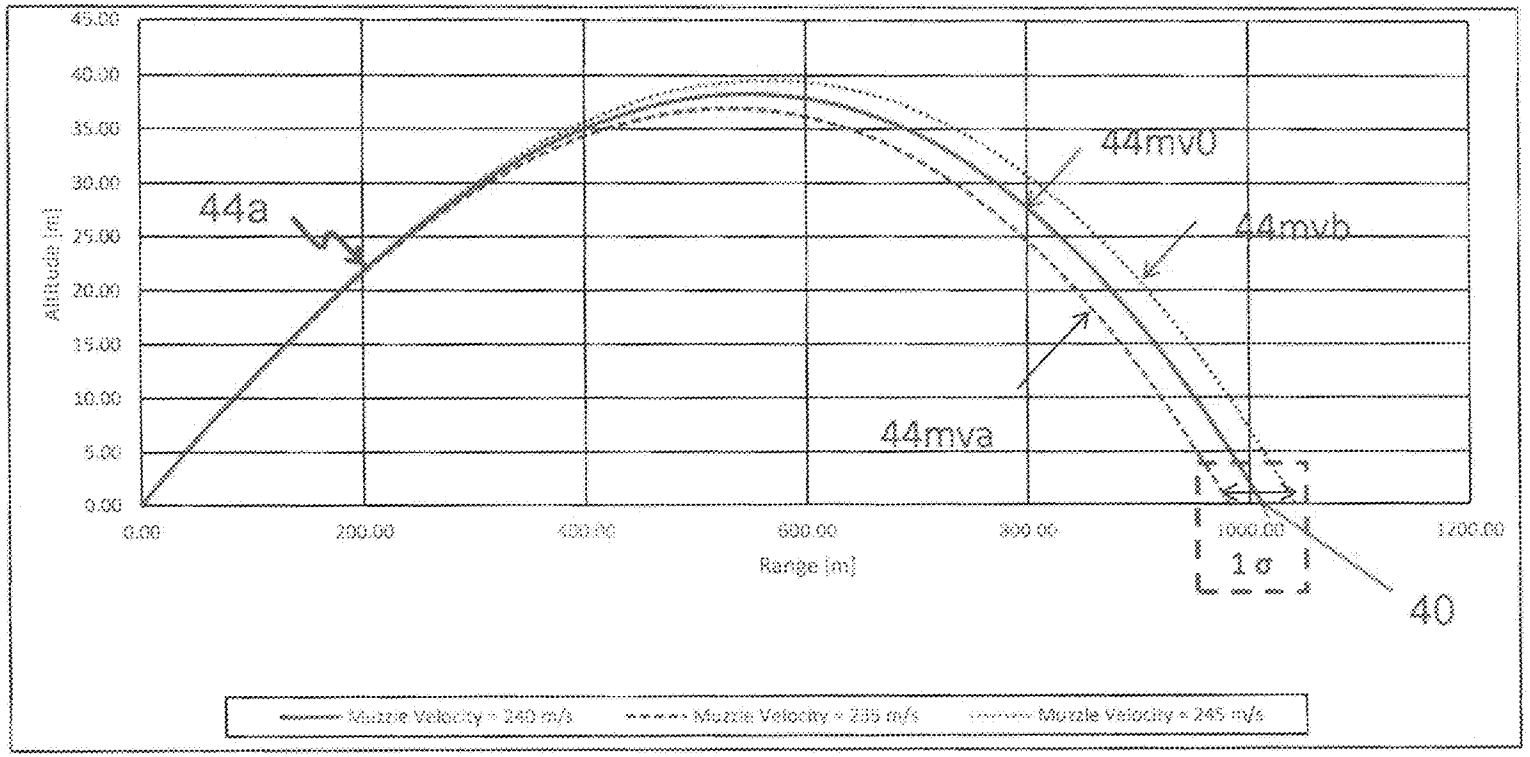
FIG. 1B depicts 40 mm terrestrial target ballistics at 1000 meters for the RWS shown in FIG. 1A.

FIG. 1A includes diagrams similar to those in the U.S. Pat. No. 8,286,872 for a remote weapon station optimized to fire air-burst ammunition. FIG. 1B depicts a 40 mm AGL ballistic flight path when aimed to impact near a ground target at 1000 meters.

Figure 1C:
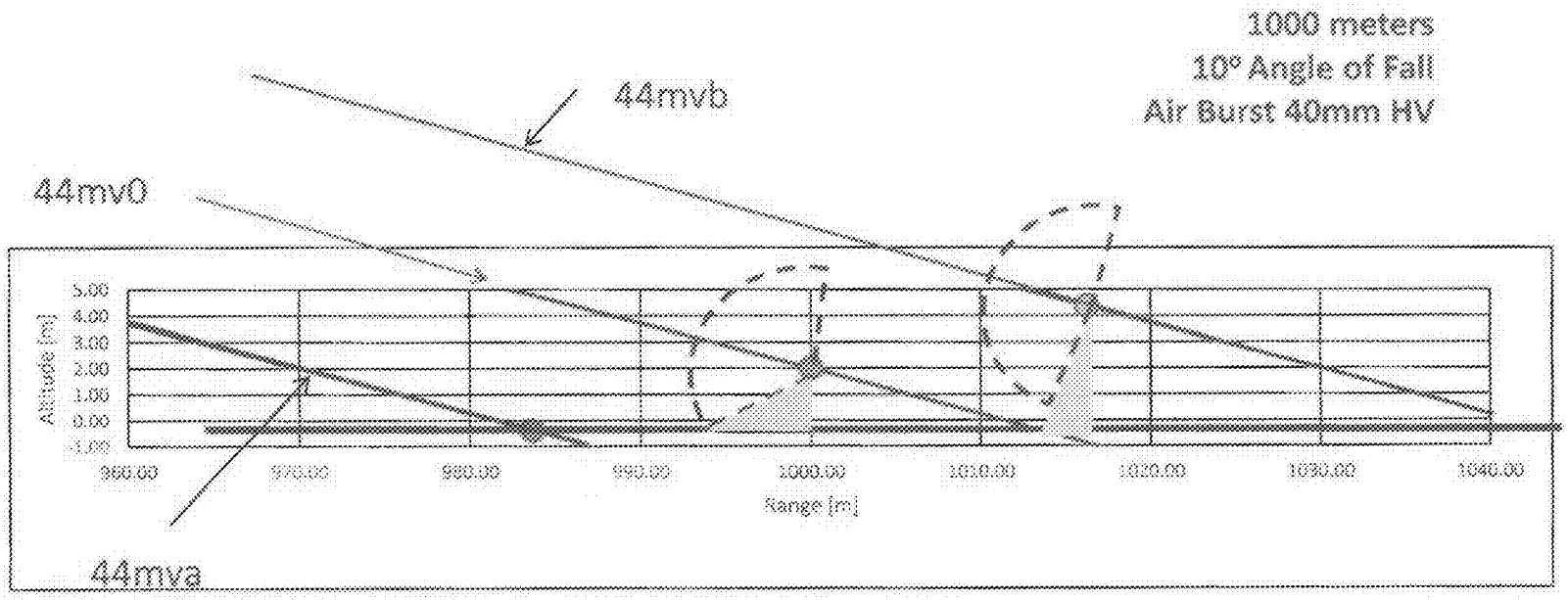
FIG. 1C depicts a detail of the 40 mm terrestrial target ballistics at 1000 meters shown in FIG. 1B.

Most fire control algorithms, presently in use, use encoded reference elevation tables and algorithms with an assumed standard muzzle velocity to calculate elevation. Unfortunately, the lot-to-lot variations of 40 mm×53 ammunition often result in the remote weapon station's missing their targets at extended ranges. FIG. 1B shows both the ballistic flight 44*mva* of a cartridge fired with a 1 sigma muzzle velocity (lower muzzle velocity compared to the firing table algorithm) and the ballistic flight path 44*mvb* of a cartridge fired with a 1 sigma muzzle velocity (above the firing tables average muzzle velocity). FIG. 1C is an enlarged view of the terminal ballistics resulting from the varying muzzle velocities 44*mv*0, 44*mva* and 44*mvb*, depicting the detonation of a programmable 40 mm×53 air-burst ammunition projectile when fired along the ballistic flight path.

Figure 1D:
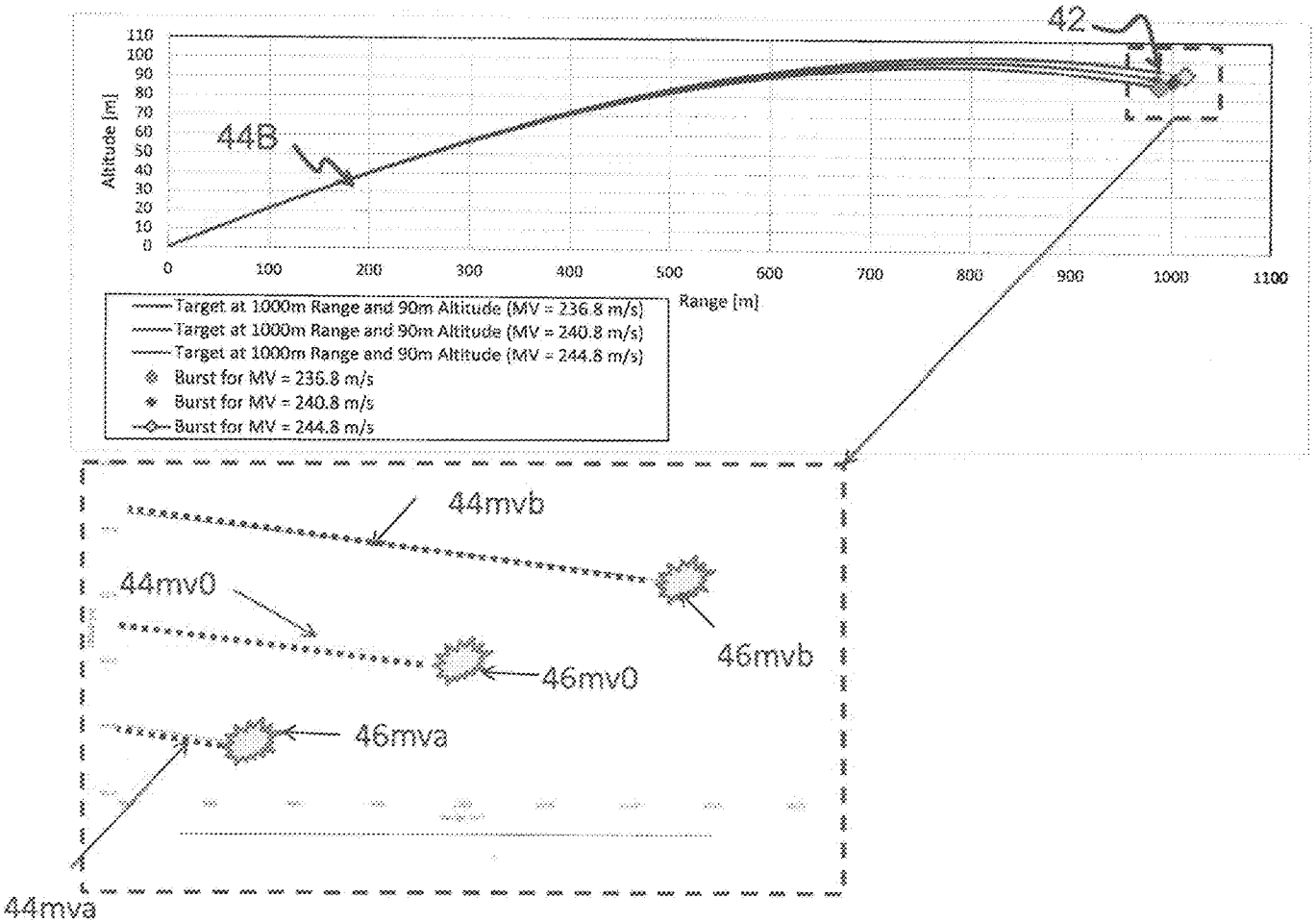
FIG. 1D depicts 40 mm drone (UAS) target ballistics at 1000 meters for the RWS shown in FIG. 1A.
Figure 1E:
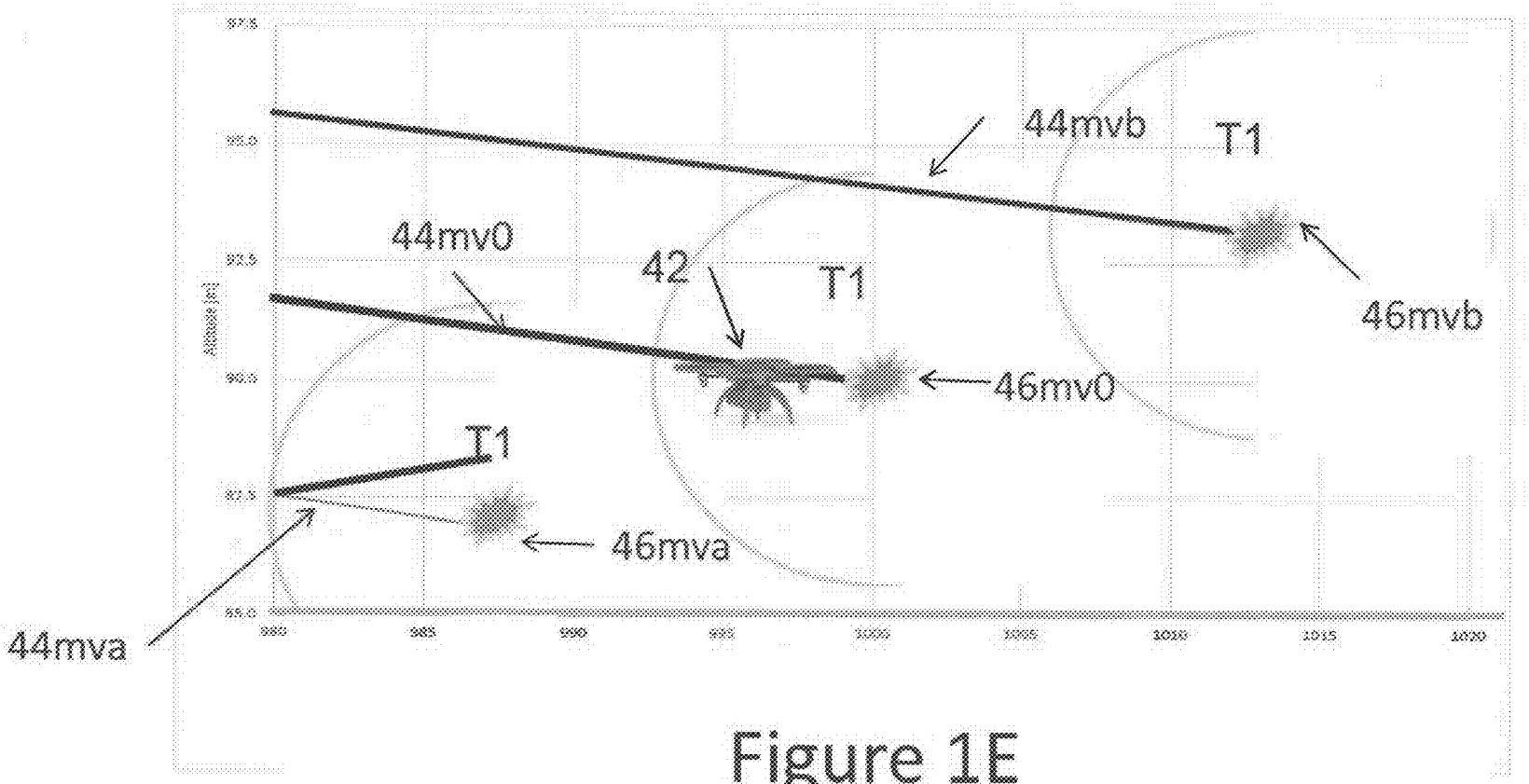
FIG. 1E depicts a detail of the 40 mm UAS target ballistics at 1000 meters shown in FIG. 1D.
Figure 1F:
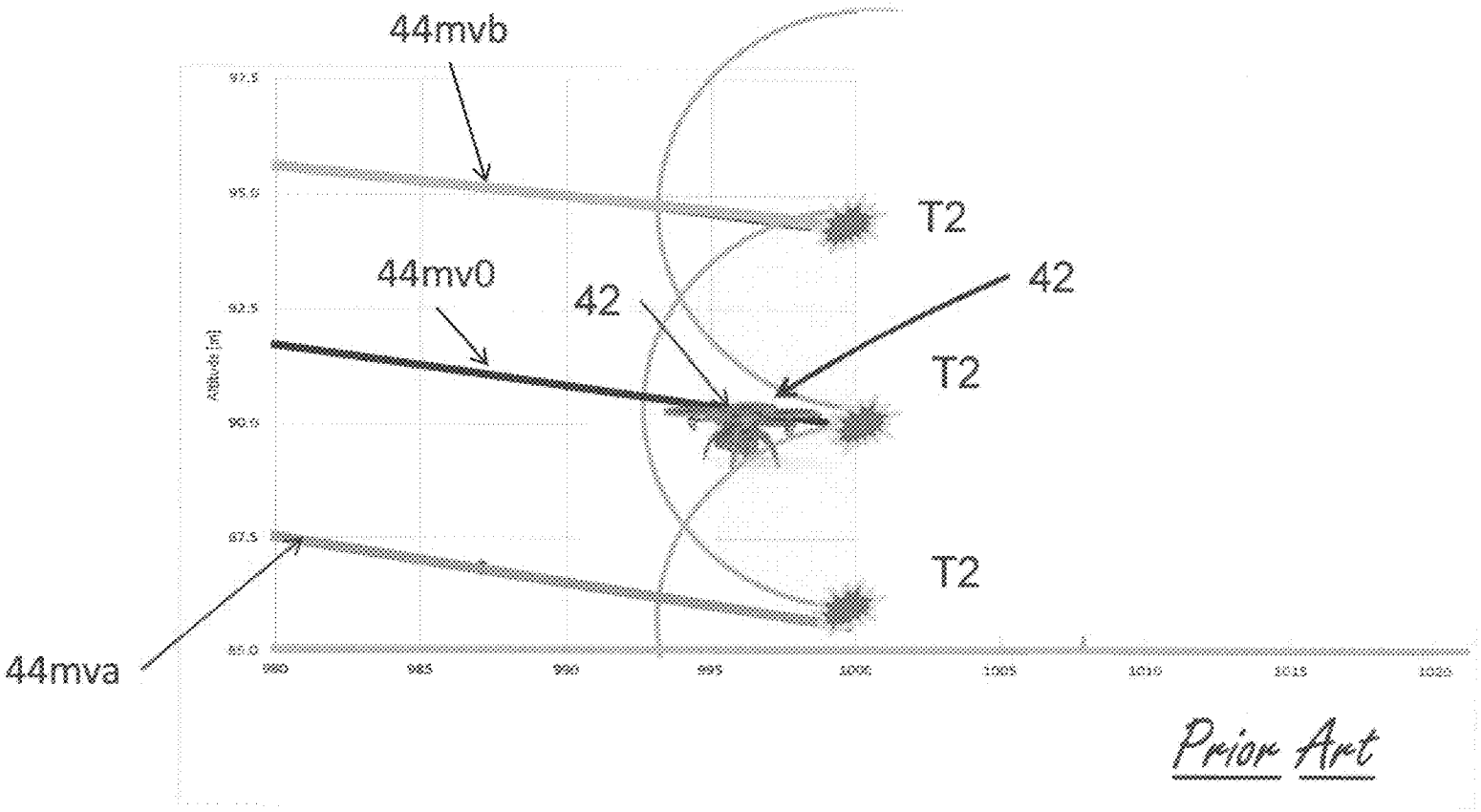
FIG. 1F depicts prior art 40 mm terminal ballistics using the methodology described in the U.S. Pat. No. 9,600,900.

FIG. 1D depicts the ballistic path 44 of a 40 mm AGL projectile firing at a target at an elevation of 90 meters and, for a set time, the detonation locations 46*mva*, 46*mv*0 and 46*mvb* along the flight paths 44*mva*, 44*mv*0 and 44*mvb*, respectively, for ammunition without adjusted programmed time to detonation and without and second volley elevation adjustment. FIG. 1E illustrates the burst point variation transposed over a target UAV 42. FIG. 1F depicts the utility of adjusting the programmed flight time (to detonation) T2 in accordance with the method disclosed in the U.S. Pat. No. 9,600,900, and an automated elevation adjustment according to the present invention.

Figure 1G:
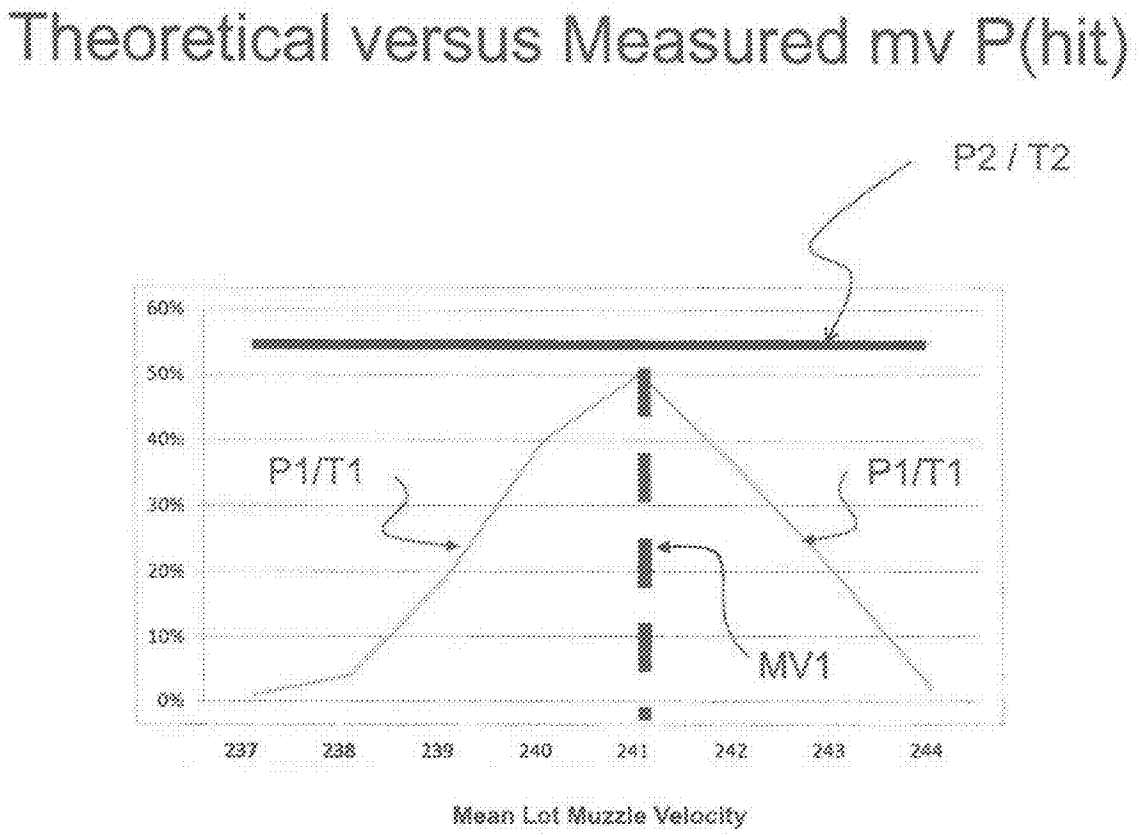
FIG. 1G is a graph of theoretical versus measured muzzle velocity and P(hit).

FIG. 1G is a simple graph, produced from modeling, identifying the mean miss distance of 40 mm high velocity ammunition for known projectile mean lot variation. FIG. 1H is a table showing the calculated probability of the average and adjusted miss distance for a first volley, as the muzzle velocity of a lot varies from the mean.

The purpose of the present invention is to improve a gunner's aiming for second and subsequent volleys. I may be incorporated into both remote weapon stations and manually-controlled weapon and fire control combinations.

Figure 2A:
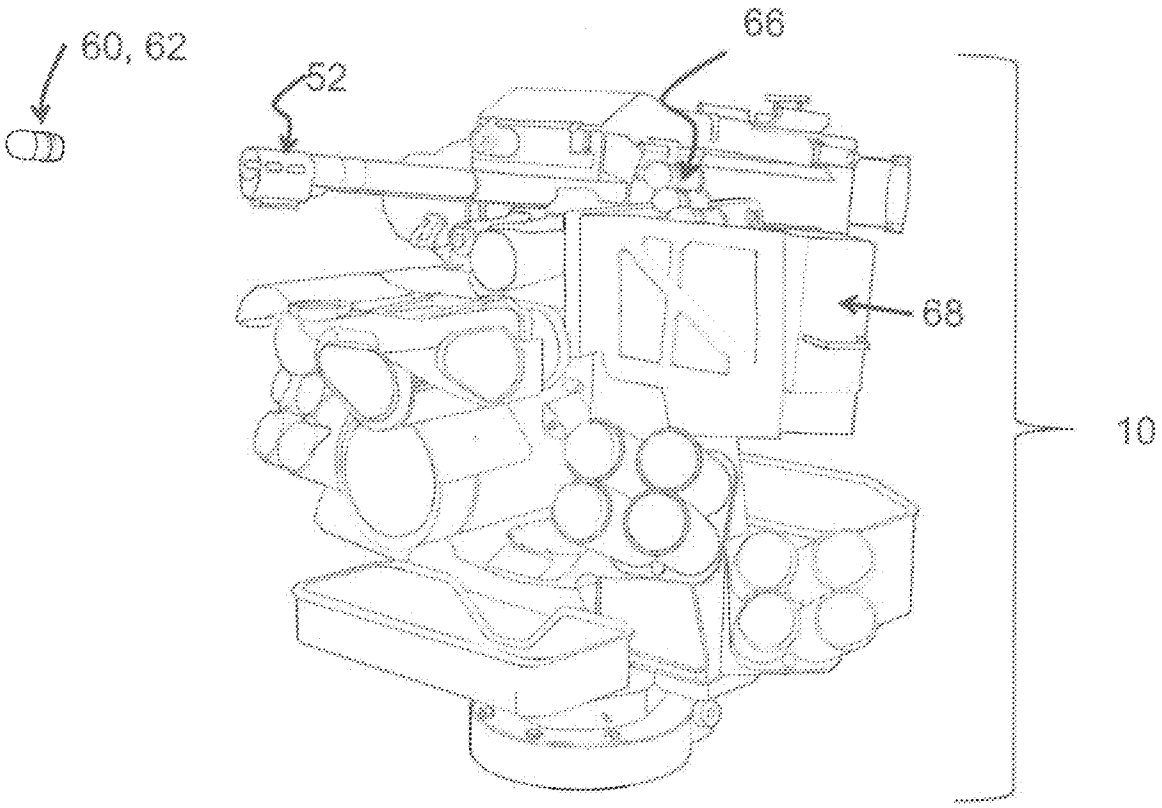
FIG. 2A shows a US M151 Remote Weapon Station ("RWS") with a muzzle velocity ("MV") measurement device on a MK19 firing an ammunition projectile.
Figure 2B:
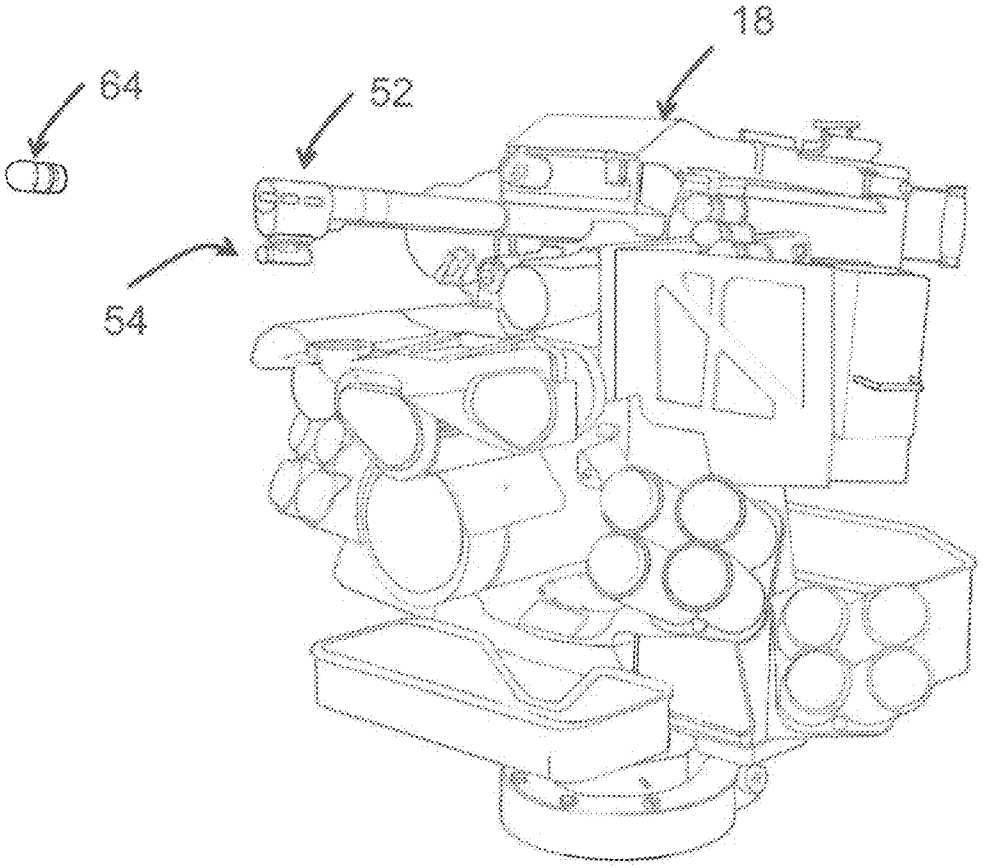
FIG. 2B shows a US M151 RWS with an MV measurement device on a MK19 firing an optically programmed projectile.

FIGS. 2A, 2B, 2C and 2D, with reference to corresponding FIGS. 3A, 3B, 3C and 3D, respectively, depict several embodiments 10 of the subject invention incorporated into a remote weapon station, with a muzzle velocity measurement device 52, that fires a projectile 60. The unfired projectiles are fitted in cartridges 66, that are stored in an ammunition can 68, in the rack of a Remote Weapon Station (FIG. 2A). These embodiments include a fire control computer 12, having a memory storage 12B and running a fire control algorithm 12D, mounted into a mechanical support 18 on a weapon. The muzzle velocity measurement device 52 feeds data to the memory storage 12B and the fire control algorithm 12D calculates the ballistic flight path. The system preferably incorporates a programmer 54 capable of programming ammunition projectiles 64 when they are fired from the weapon.

Figure 2C:
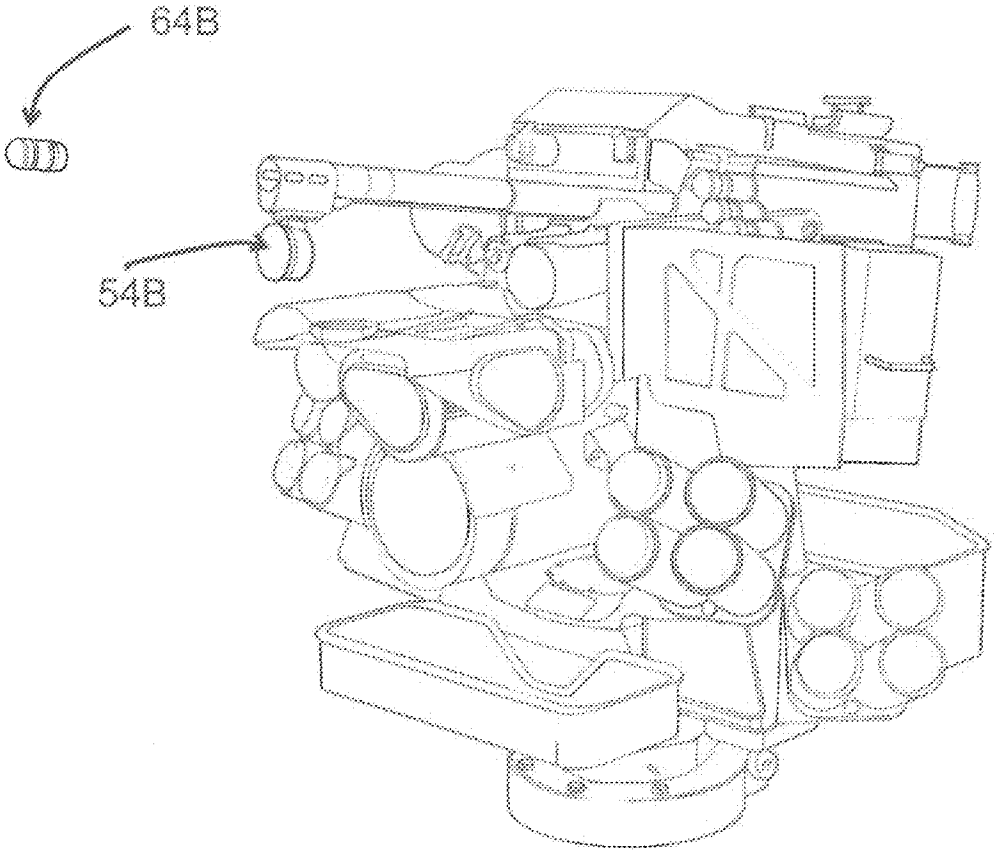
FIG. 2C shows a US M151 RWS with an MV measurement device on a MK19 firing an RF or extended range magnetically programmed projectile.

FIG. 2C depicts an RF programmer 54B on the muzzle of the weapon that programs an RF programmable projectile 64B. After a first volley V1, the system automatically re-aims, the mounted weapon producing an improved aiming elevation.

The embodiments of the invention shown in FIGS. 2A, 2B, 2C and 2D operate to fire a projectile 60, which may be conventional 62 or programmable 64. These embodiments include a muzzle velocity measurement device 52 that measures each projectile's muzzle velocity MV, stores this muzzle velocity in the memory 12B, and then employs the ballistic algorithm 12D to recalculate and reset the elevation 22B after firing. The second and subsequent volleys thus have an improved aim elevation, compared to the first volley.

Figure 2D:
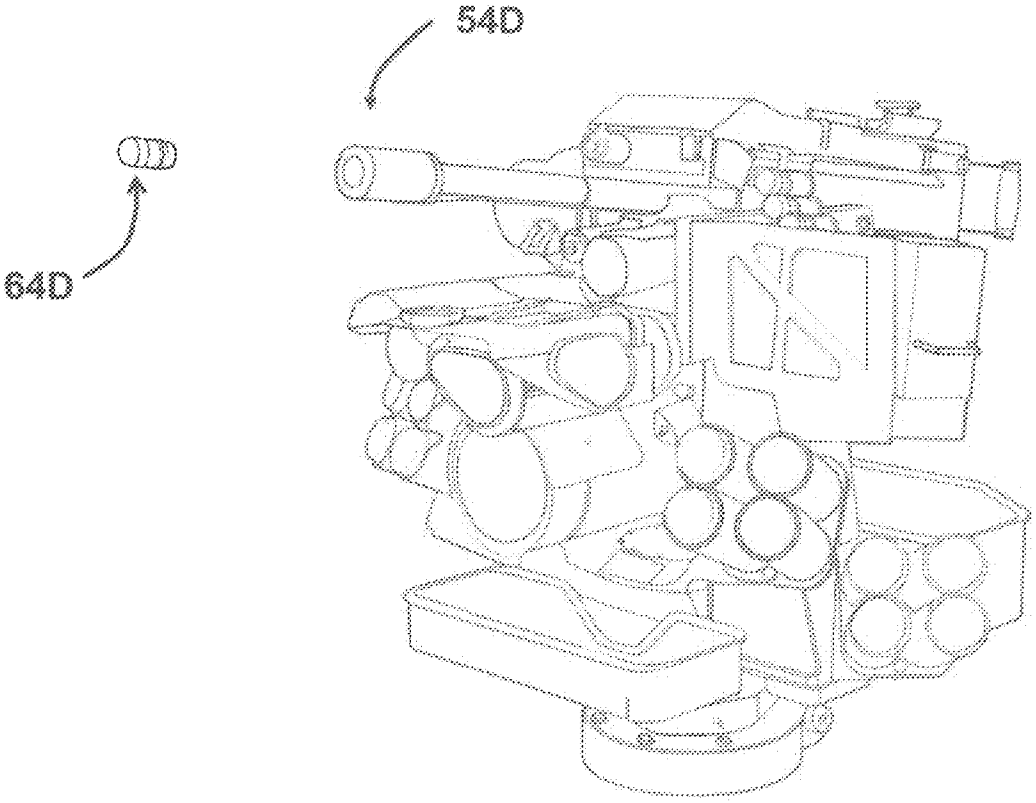
FIG. 2D shows a US M151 RWS with an MV measurement device.

FIG. 2D depicts an in-bore programmed projectile 64D, with an in-bore muzzle velocity measurement and programmer 54D as provided for in the Oerlikon (AHEAD) patents referred to above, which are licensed to STK (Singapore) and to General Dynamics Ordnance and Tactical Systems (US).

Figure 2E:
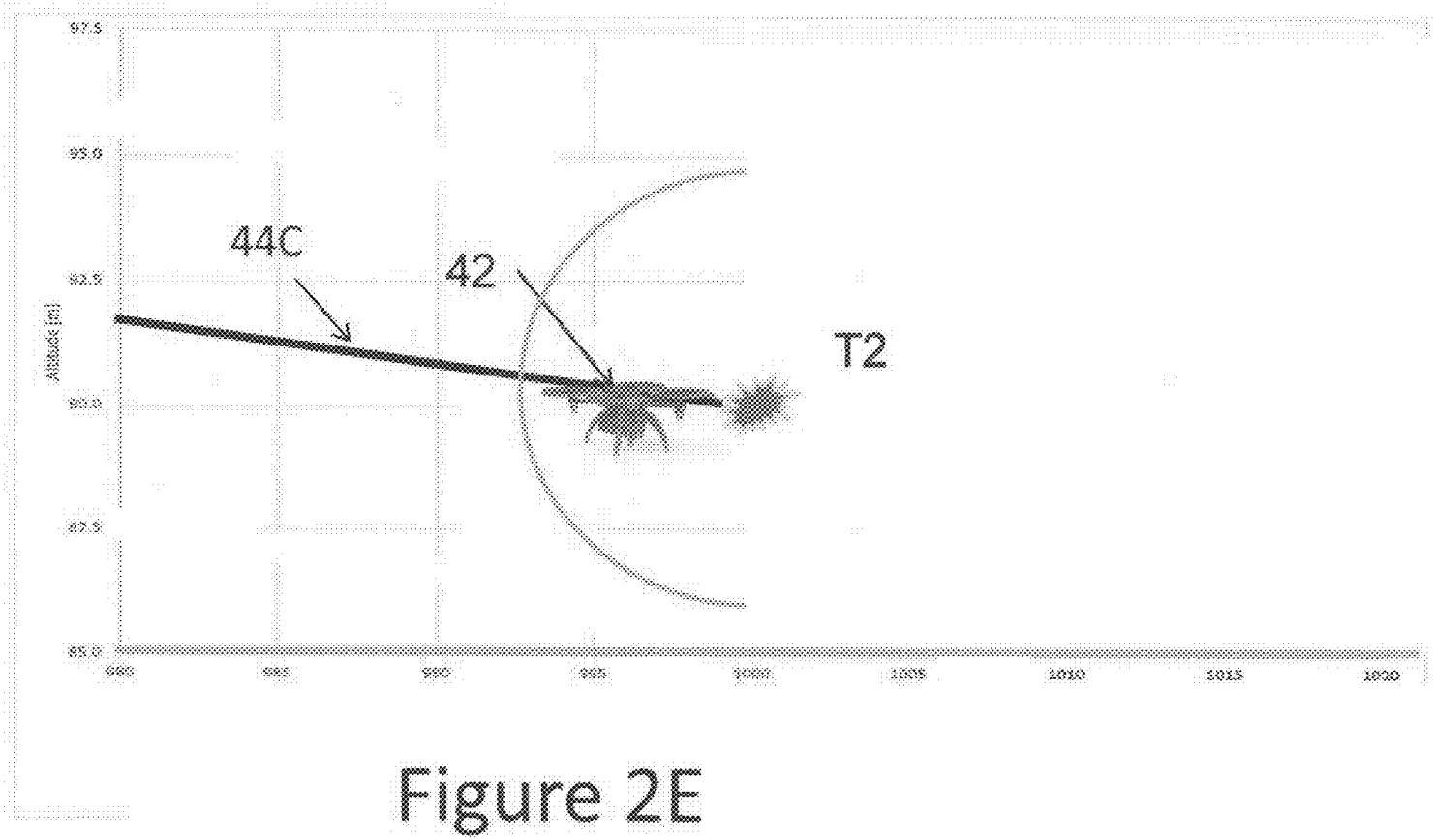
FIG. 2E depicts 40 mm UAS target ballistics at 1000 meters for the US M151 RWS with an MV measurement device shown in FIG. 2D.
Figure 2F:
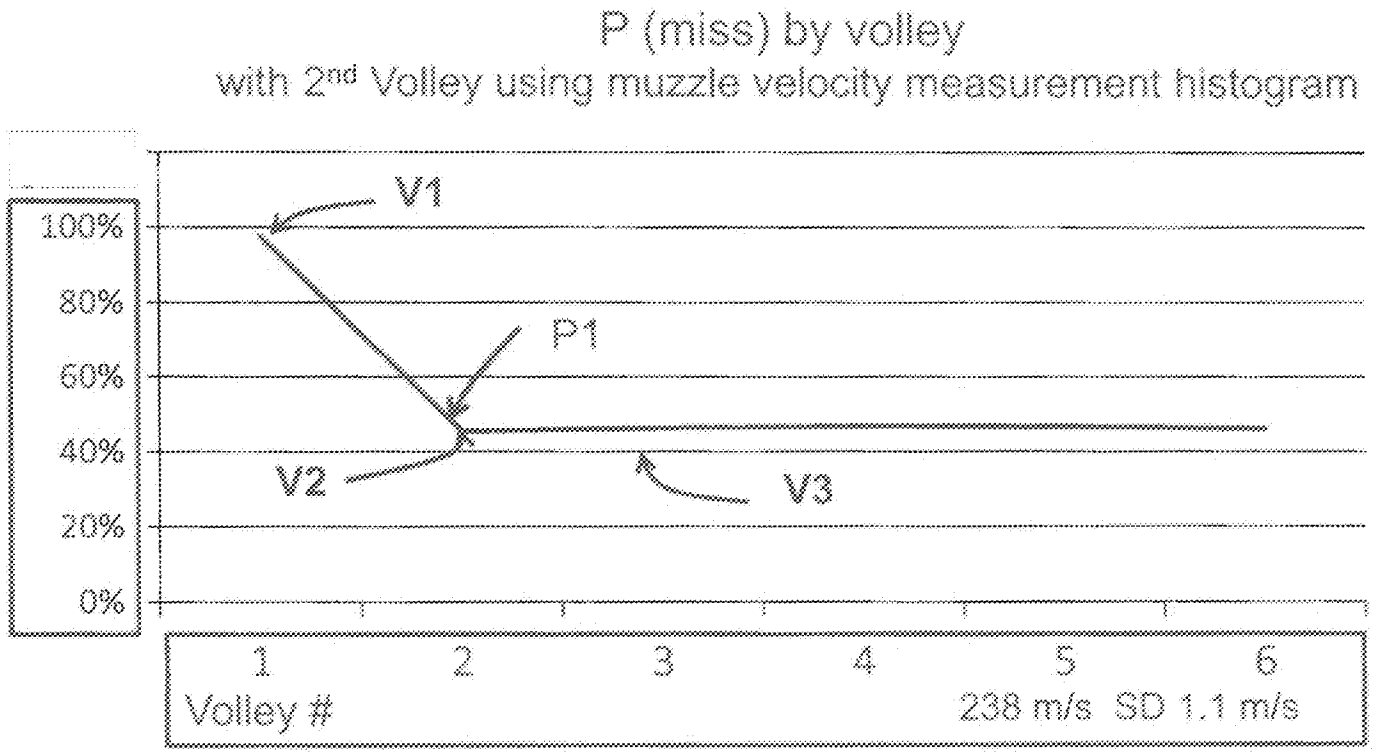
FIG. 2F depicts the average miss distance resulting from a 40 mm (lot) muzzle velocity variation from a ballistic solution's theoretical solution.

FIGS. 2E and 2F depict the expected improvement in firing with an unmanned system located at a range of 1000 meters and at an altitude of 90 meters. FIG. 2E depicts the projectile's improved ballistic path 44C, and the projectile's detonation at an adjusted time T2 in close proximity to the target 42. FIG. 2F depicts the forecasted improvement of a remote weapon station with the remote adjustment of the second volley, where the first volley V1 has a low probability of hit and the second volley V2 has an improved probability of hit P1. The initial aim point 12E for the initial firing test uses the assumed muzzle velocity for the lot of ammunition.

Figure 3A:
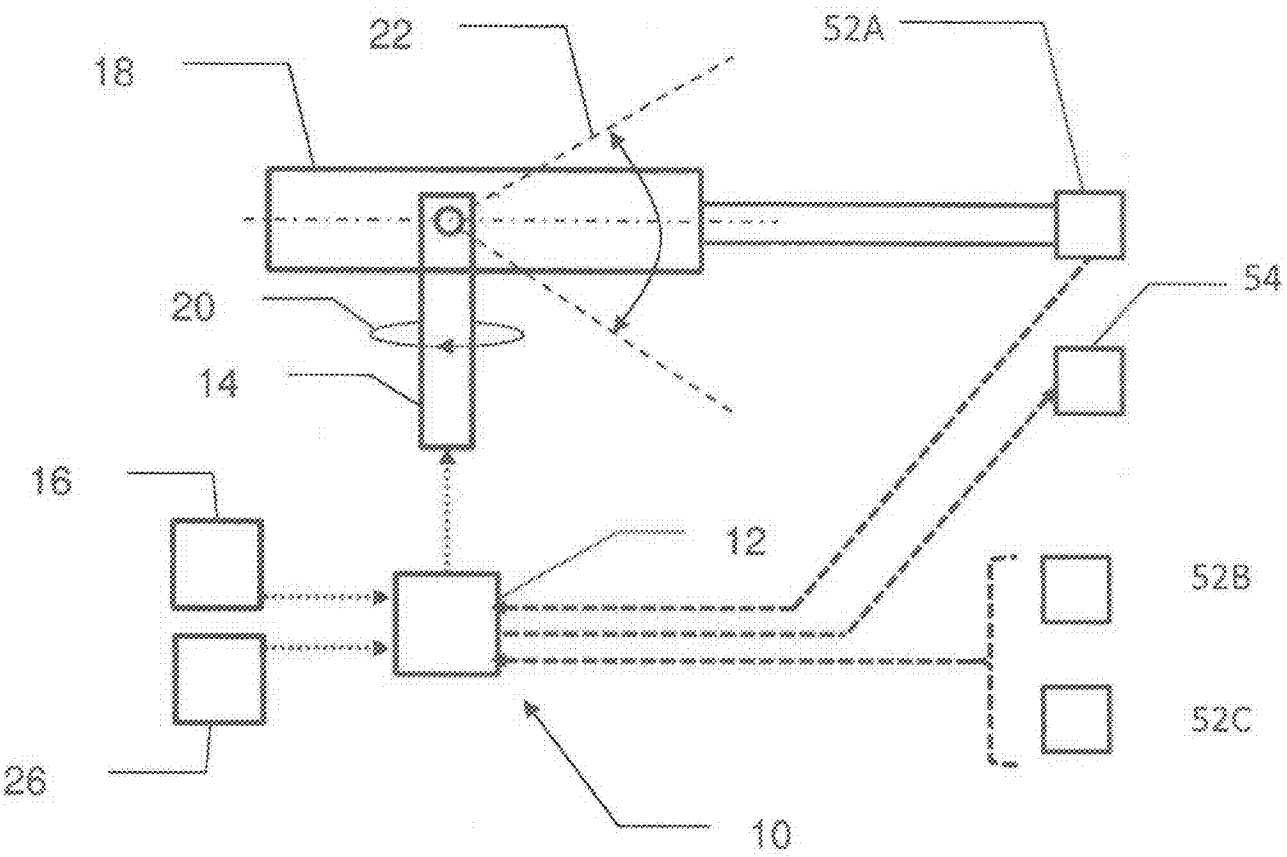
FIG. 3A is a system block diagram for a US M151 RWS, improved with the addition of a muzzle velocity measurement and an air-burst programmer.
Figure 3B:
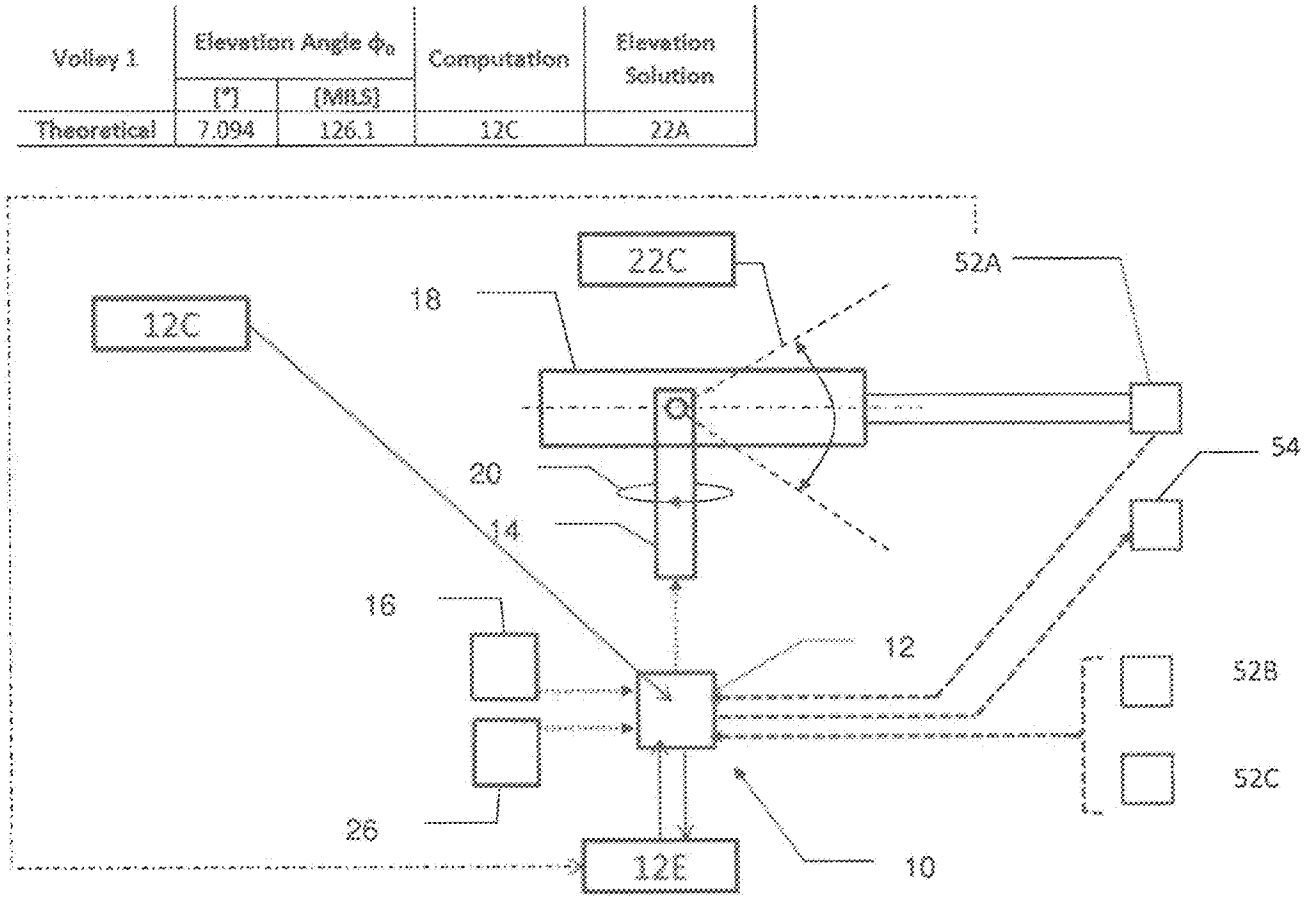
FIG. 3B is a system block diagram for a US M151 RWS, firing a second volley with an improved system function to measure muzzle velocity, adjusting elevation and firing a programmable air-burst projectile. The table in the top left corner of the figure depicts a method of computation used in the fire control ballistic computer and a resulting elevation solution.
Figure 3C:
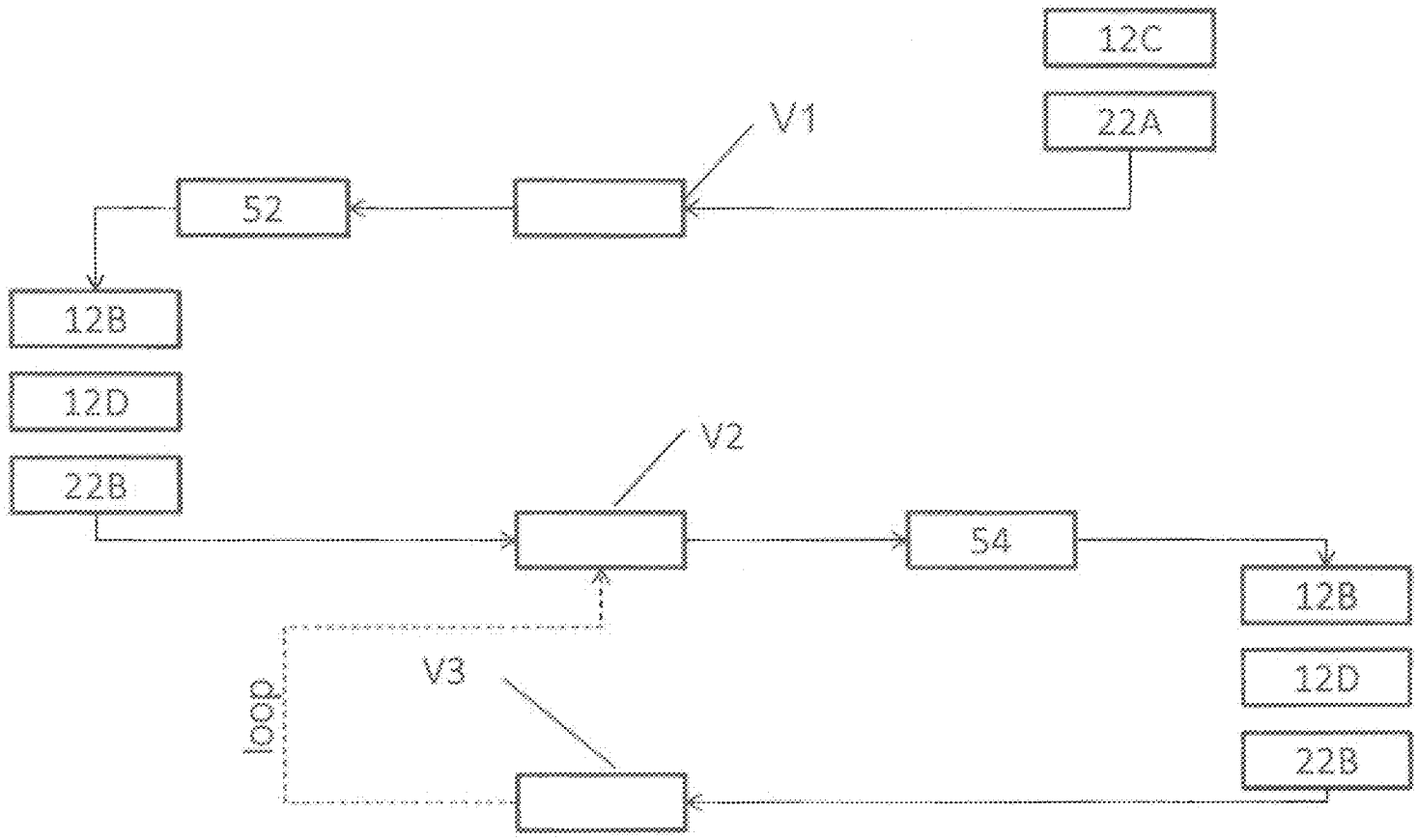
FIG. 3C is a system function sequence diagram for an exemplary initial commutation, based on an algorithm or table, identifying an elevation solution for a second volley with a re-adjusted elevation, where the weapon system previously measured the first volley muzzle velocity.

FIG. 3A depicts a remote weapon station system with a muzzle velocity measurement device 52A, 52B, 52C and programmer 54. With reference to FIG. 3B, the remote weapon station firing a first engagement volley aims the weapon using a theoretical or default muzzle velocity 12C and may adjust the users aiming point 12F. As represented in FIG. 3C, a second volley is aimed using a ballistic solution algorithm 12D that runs, based on the measured muzzle velocity. FIG. 3C depicts the sequence of fire control sub-routines of a first, second and subsequent volley.

FIG. 3A is an external view of improved remote weapon configuration according to the invention, with a muzzle velocity measurement device 52 mounted on a weapon's muzzle. FIG. 3B shows a system diagram for US M151 RWS Remote Weapon Station that includes a conventional muzzle velocity measurement device 52A, or a radar device 52B that may include a position sensor 52C, such as that disclosed in U.S. Pat. No. 8,074,555. This RWS system operates with a projectile programmer 54.

The initial commutation in the system of FIG. 3B is based on an algorithm or table 12C, identifying an elevation solution 22C. The table (left top) identifies the theoretical elevation for a 40 mm AGL cartridge where the solution is derived from a firing table.

FIG. 3C is a process flow diagram illustrating the remote weapon station's control sequencing when firing volleys V, with control sub-routines identified. The exit velocity of the first volley V1 is measured at 52 and a fire control computer 12B then calculates a fire control solution 12C based on an algorithm that uses a default muzzle velocity. When firing a second volley V2, an alternative fire control algorithm 12D re-adjusts the elevation 22B.

Figure 3D:
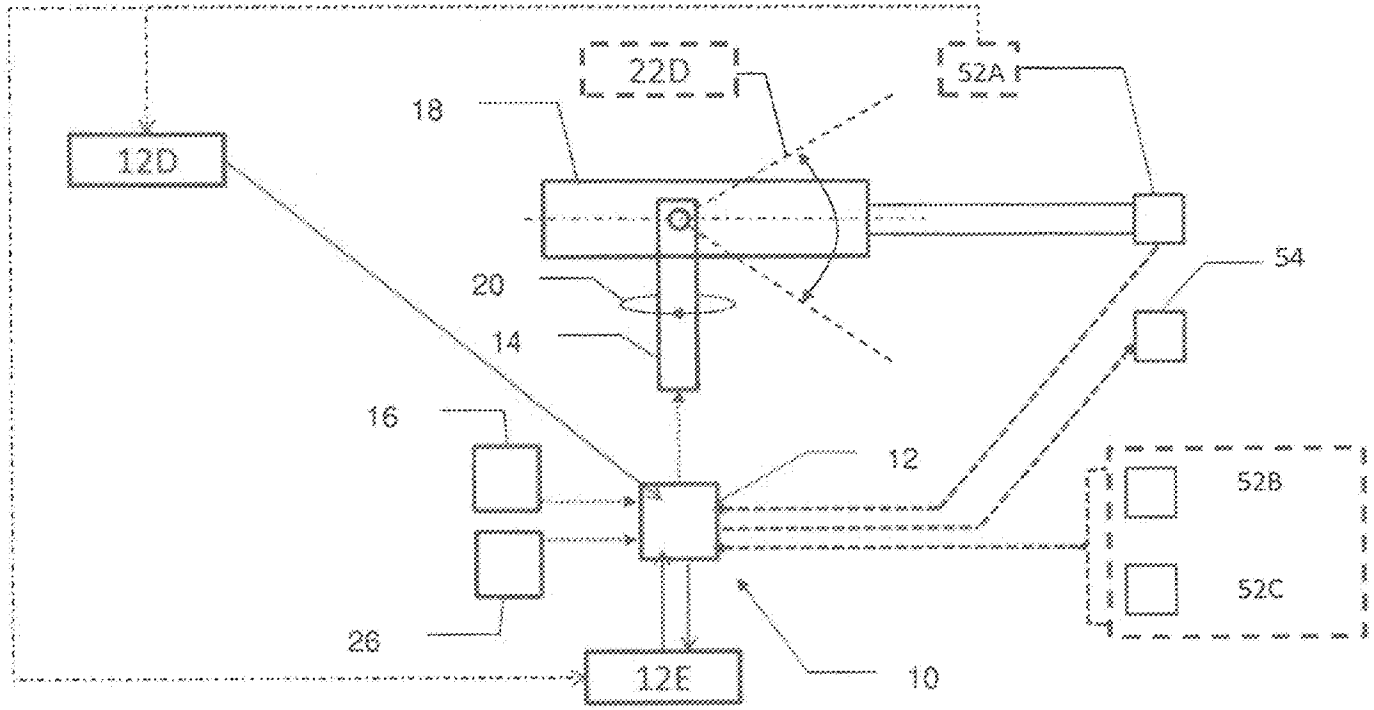
FIG. 3D is a system function sequence diagram for a second volley elevation solver using a histogram of prior shots data, producing a revised solution for a second and subsequent volleys. The diagram depicts sequencing of volleys and fire control sub-routines where a first volley calculates a solution based on a default muzzle velocity and second and subsequent volleys use actual measured muzzle velocity.

FIG. 3D shows a system in which the muzzle velocity of an initial volley is measured at 52A and a fire control computer 12, using measured velocity V1, re-adjusts the weapon and mechanical support 18 to a second elevation solution. This system relies on a histogram of prior shot muzzle velocity data stored in the fire control memory.

Figure 4A:
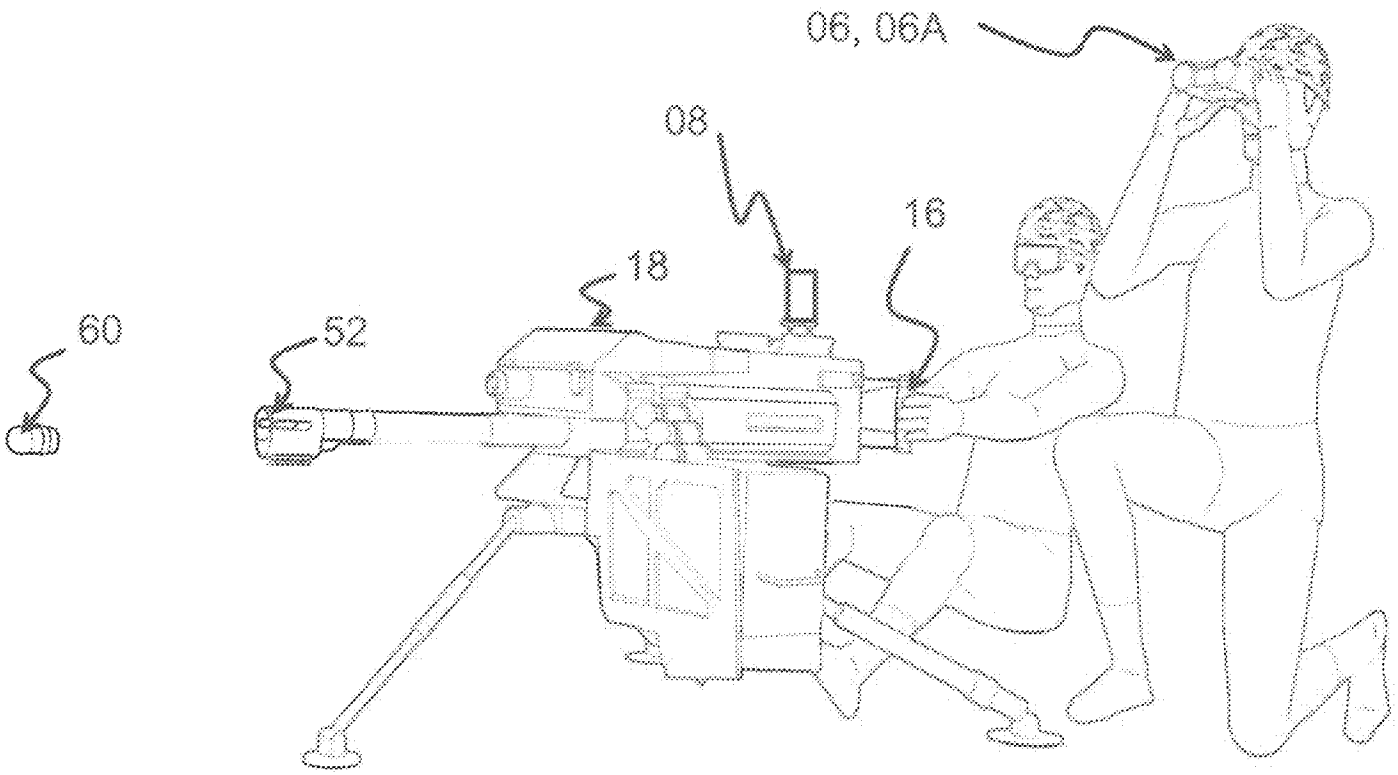
FIG. 4A depicts a manually-adjusted weapon, with a muzzle velocity sensor, a fire control and range finder incorporated into external binoculars.
Figure 4B:
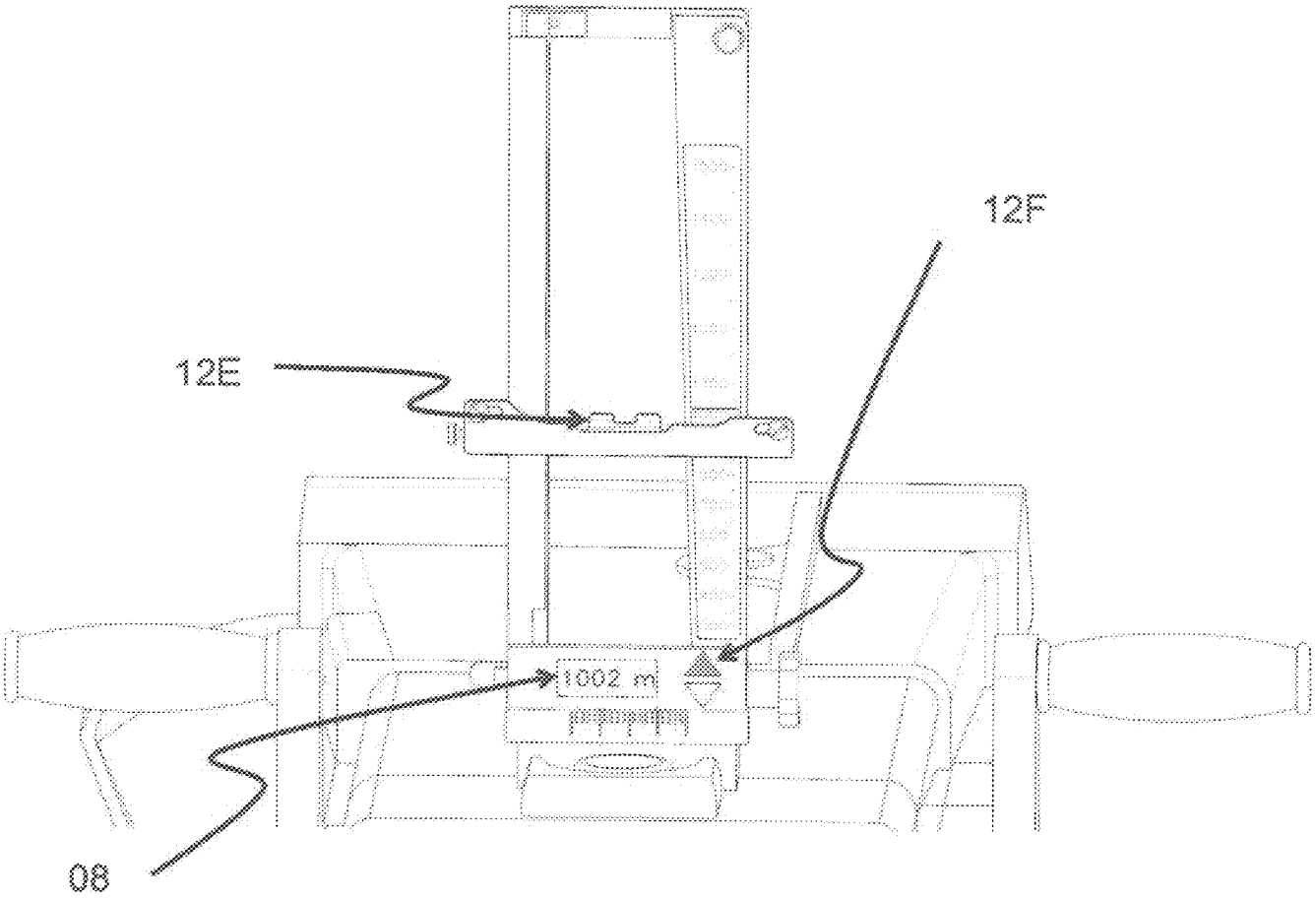
FIG. 4B depicts two views of an MK19 weapon from the gunner's perspective, showing a range output and an adjustment indicator.
Figure 4C:
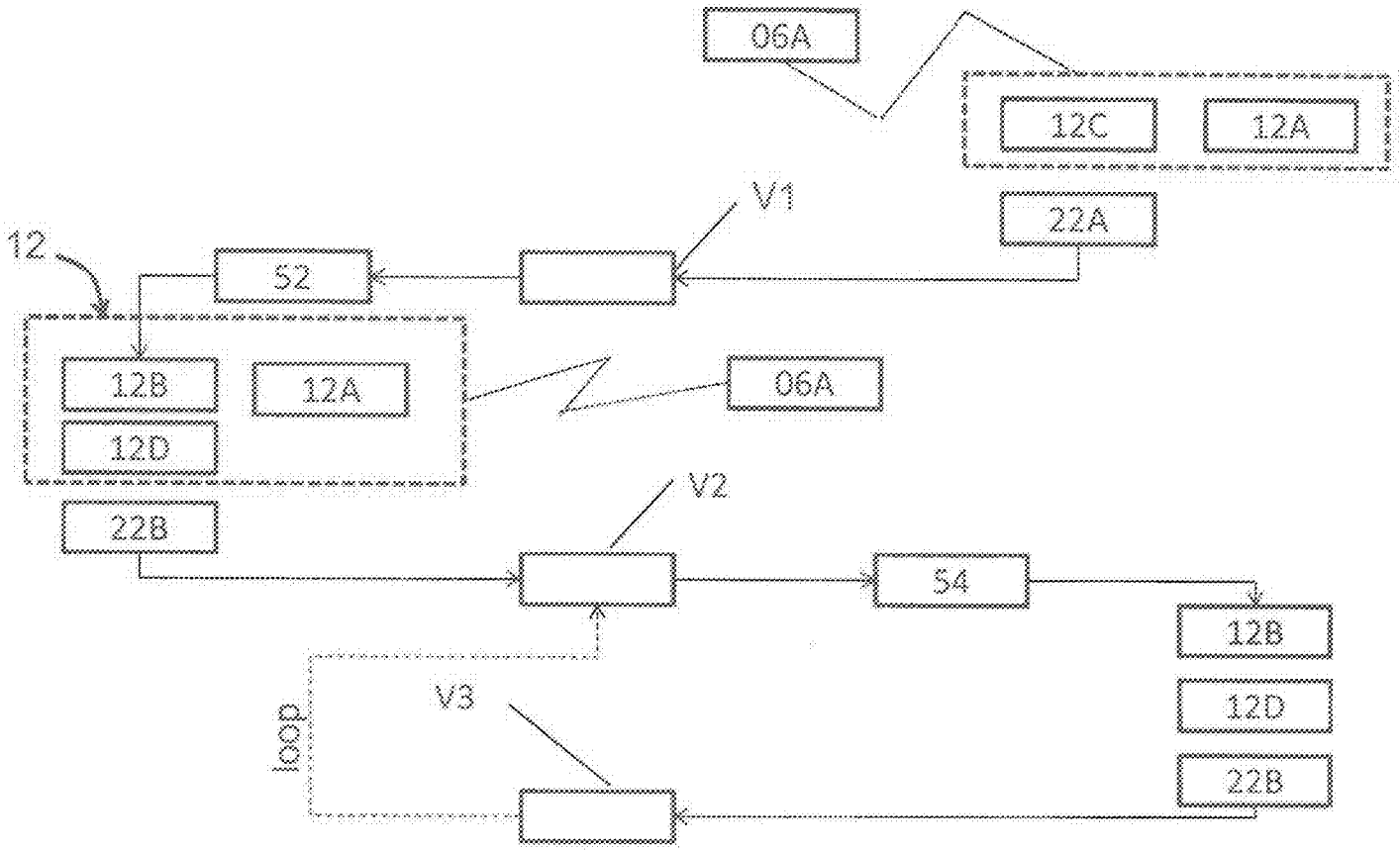
FIG. 4C is a system function sequence diagram showing an initial and subsequent elevation solutions.
Figure 4D:
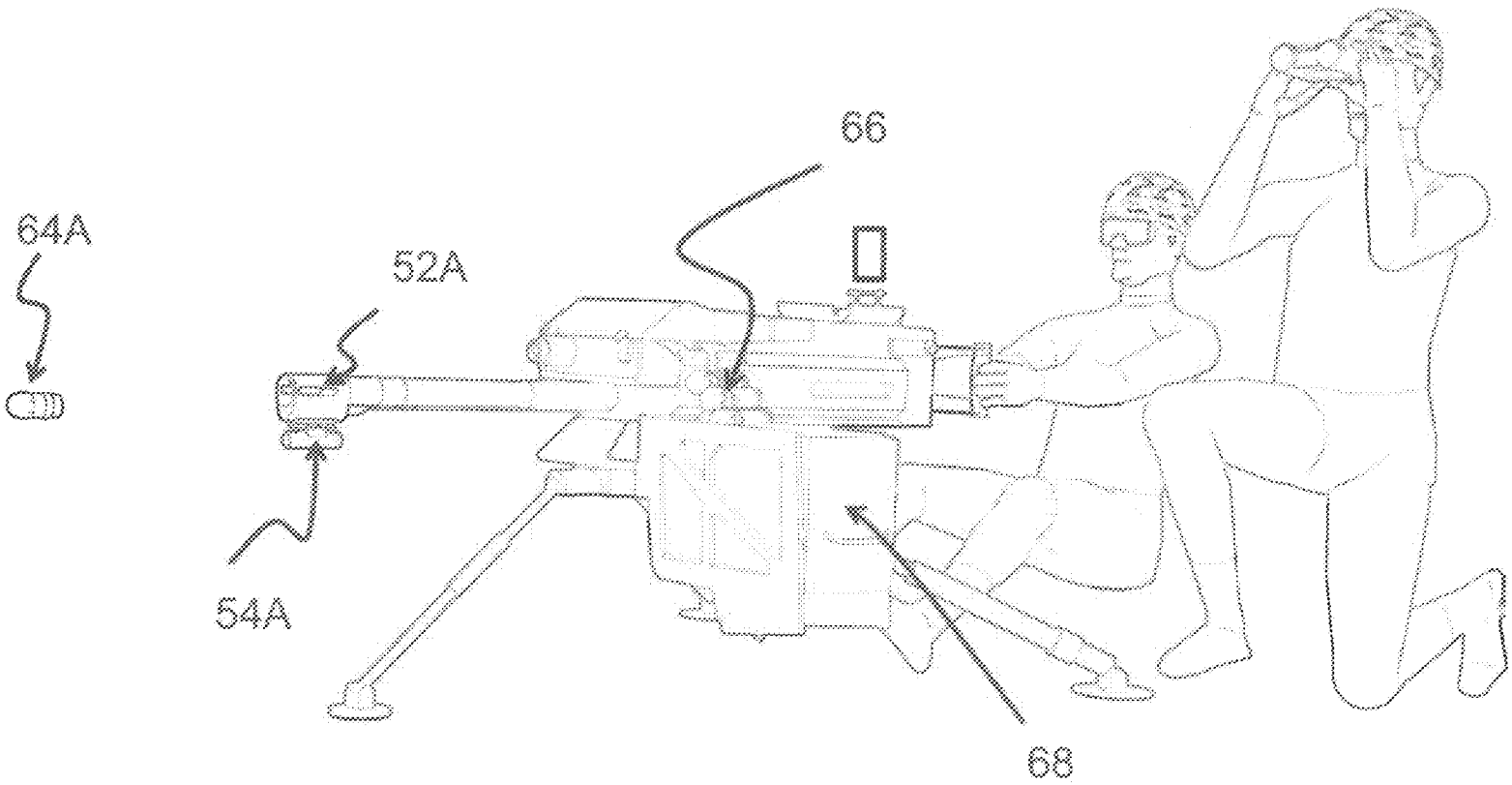
FIG. 4D depicts a manually-adjusted weapon, with a muzzle velocity sensor and a fire control device with a range finder incorporated into external binoculars. The weapon system is fitted with an optical programmer to set the detonation time of a programmable projectile.
Figure 4E:
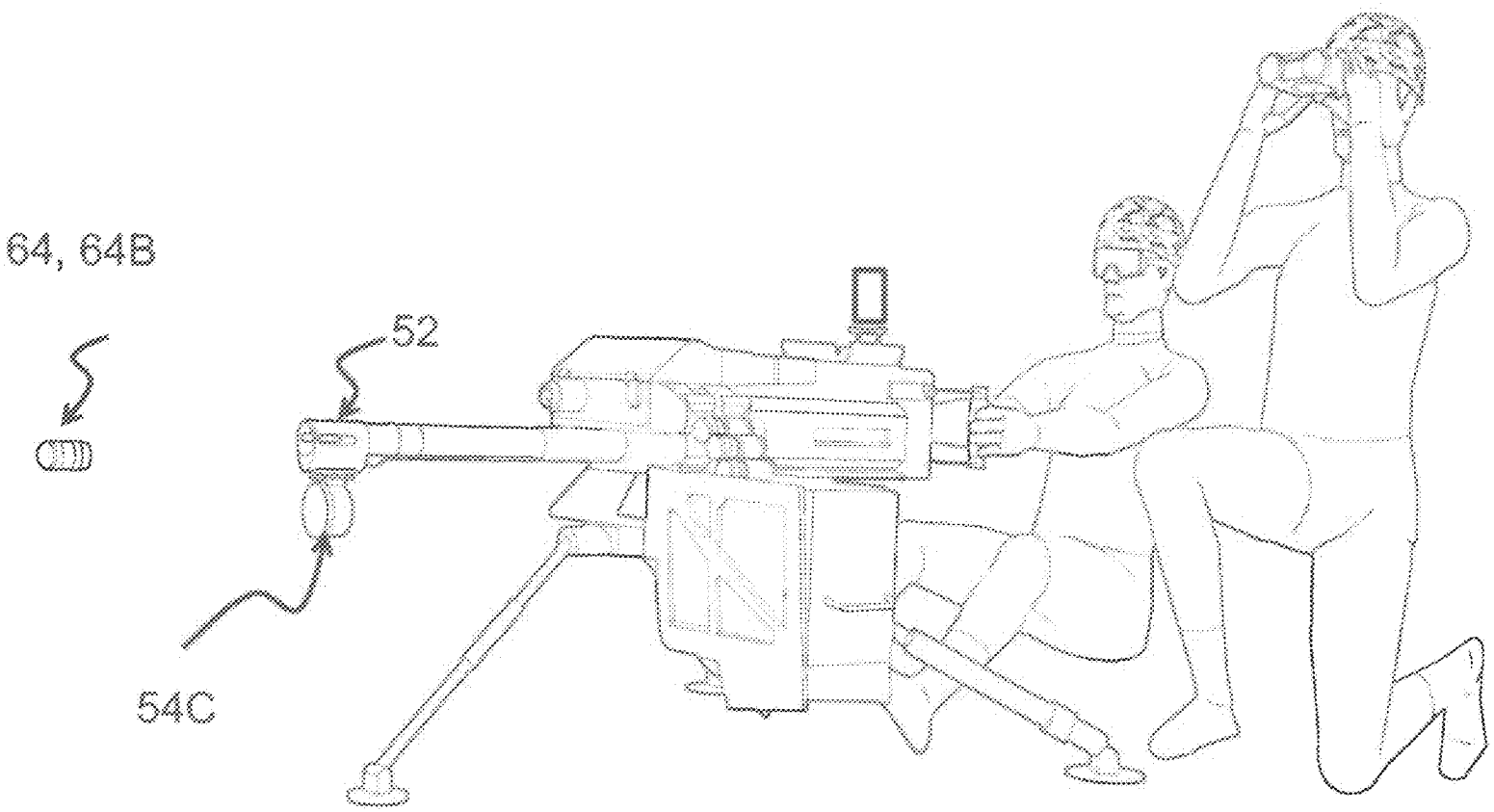
FIG. 4E depicts a manually-adjusted weapon, with a muzzle velocity sensor and a fire control device with range finder incorporated into external binoculars. The system is fitted with an RF or Extended Range Magnetic Induction programmer to set the detonation time of a programmable projectile.
Figure 4F:
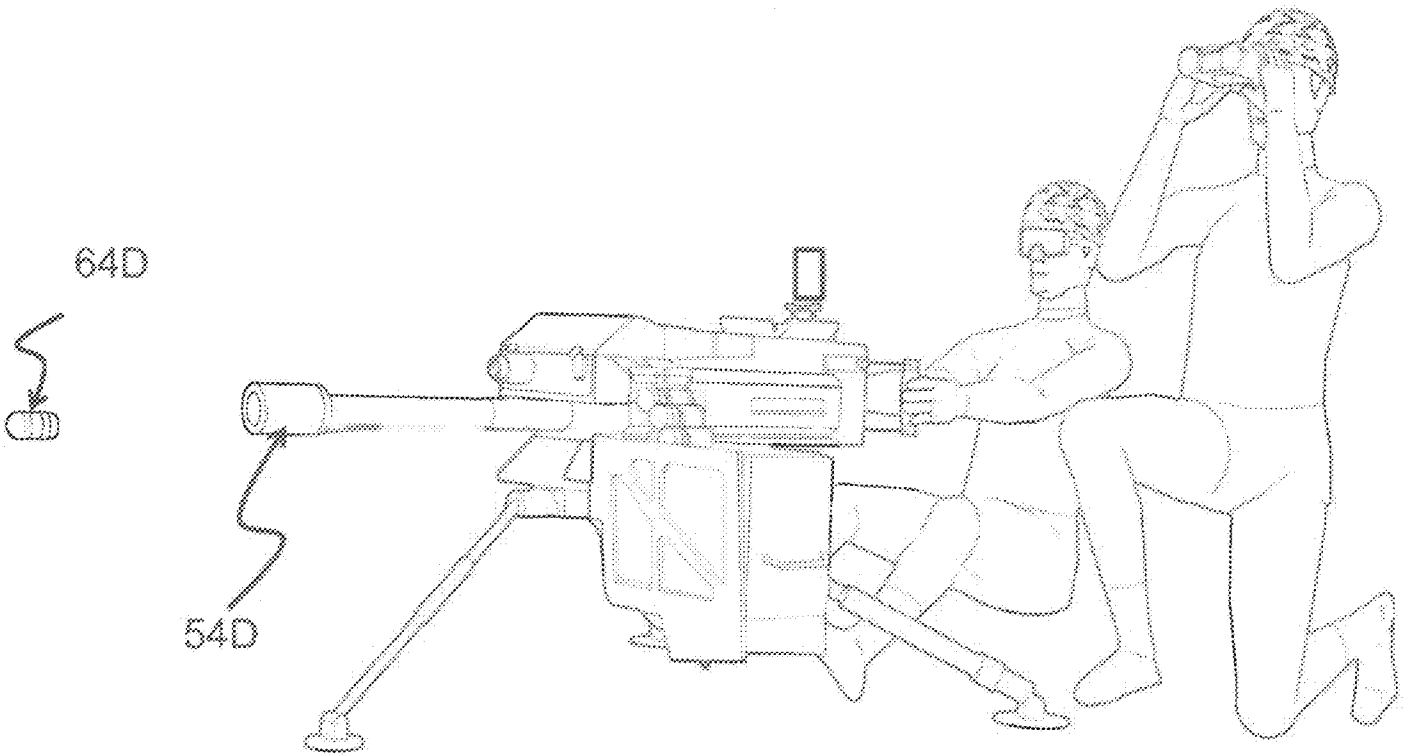
FIG. 4F depicts a manually-adjusted weapon, with a muzzle velocity sensor and a fire control device with range finder incorporated into external binoculars. The system is fitted with an Oerlikon AHEAD type of programmer to set the detonation time of a programmable projectile.

FIGS. 4A, 4B, 4C, 4D and 4E depict an alternative embodiment of the invention having a manually-elevated mounted weapon 18, with a display 08, connected to a fire control system 12D with a projectile velocity measurement sensor 52, where the system includes external range-finding binoculars with a data link 06A (either galvanic or wireless). This system may fire conventional cartridges 60 as depicted in FIG. 4A or programmable cartridges 64A, 64B and 64D as depicted in FIGS. 4D, 4E and 4F. FIG. 4F, similar to FIG. 2D, depicts the sequencing of firing the manually-elevated weapon with an in-bore muzzle velocity measurement and programmer 54D.

Range-finding binoculars with a data link output (for example, Bluetooth wireless or an RS232 cable connection) that are suitable for use with this system are available commercially. Examples are:

1. Zeiss Victory 10×45 T RF range-finding binoculars (with laser ballistic information system—BIS);
2. Nikon Laser force 10×42 mm range-finding binoculars (with a 905 nm laser range finder);
3. Leica Geovid 10×46/10×56 range-finder binoculars;
4. Steiner 8×30 military LRF binoculars (with laser range-finder and RS232 cable output for a galvanic interface connection); and 5. Newcon Optik LRB 4000 CI laser range-finder binoculars with an RS232 cable output interface.

The binoculars are used manually to determine range to the target and transmit the range to the fire control system 12D.

There has thus been shown and described a novel method and apparatus for improving the aim of a remote weapon station (RWS), when firing either a point-detonating or a programmable air-burst projectile, that fulfills all of the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A method of aiming a weapon station when firing projectiles toward a target, said weapon station comprising a weapon barrel with a muzzle, a mechanical support for controlling the elevation and traverse of the barrel, sensing means for determining the muzzle velocity (MV) of a projectile when exiting the barrel and a fire control processor for calculating barrel elevation for ballistic flight of the projectile toward a desired target in dependence upon certain input parameters, said method comprising the steps of:

(a) inputting to the processor, initially, an estimated default muzzle velocity for a given ammunition can of a selected type of ammunition projectile;

(b) inputting to the processor a range to the target;

(c) adjusting the barrel elevation based on the default MV and the range to the target for the ballistic flight toward the target of a projectile from said given ammunition can of projectiles;

(d) firing at least one projectile from said given ammunition can of projectiles toward the target;

(e) determining an actual MV for said at least one projectile;

(f) adjusting the barrel elevation based on said actual measured muzzle velocity and said range to the target;

(g) firing at least one additional projectile from said given ammunition can of projectiles toward the target.

2. The method defined in claim 1, further comprising the step of repeating steps (e) through (g) for at least one further projectile selected from said given ammunition can of projectiles.

3. The method defined in claim 1, further comprising the steps (a) through (g) for cartridges from another ammunition can of projectiles.

4. The method defined in claim 1, wherein said at least one projectile is a point-detonating projectile.

5. The method defined in claim 1, wherein said at least one projectile is a programmable air-burst projectile.

6. The method in claim 5, wherein the programmable projectile has an optical sensor or modem for receiving optical programming signals emitted from a transmitter electronically connected to, and physically adjacent to, the weapon station, and wherein said method further comprises the steps of generating and transmitting said programming signals to said programmable projectile for adjusting a time of projectile detonation after firing.

7. The method in claim 5, wherein the programmable projectile has an RF antenna that receives RF programming signals emitted from a transmitter electronically connected to, and physically adjacent to, the weapon station, and wherein said method further comprises the steps of generating and transmitting said programming signals to said programmable projectile for adjusting a time of projectile detonation after firing.

8. The method in claim 5, wherein the programmable projectile has a magnetic sensor that receives modulated electro-magnetic programming signals emitted from a magnetic modulating programmer electronically connected to, and physically adjacent to, the weapon station, and wherein said method further comprises the steps of generating and transmitting said programming signals to said programmable projectile for adjusting a time of projectile detonation after firing.

9. The method in claim 5, wherein the programmable projectile has an antenna that receives microwave band electro-magnetic programming signals emitted from a focused microwave programmer electronically connected to, and physically adjacent to, the weapon station, and wherein said method further comprises the steps of generating and transmitting said programming signals to said programmable projectile for adjusting a time of projectile detonation after firing.

10. The method of claim 1, wherein said given ammunition can of projectiles include a linked chain of projectiles.

11. A weapon station including a weapon with a barrel having a muzzle for firing ammunition projectiles from an ammunition can of projectiles and comprising:

a mechanical support configured to elevate and averse said weapon barrel;

a sensing device, disposed in or adjacent said barrel, for measuring an exit muzzle velocity (MV) of a fired ammunition projectile;

a fire control unit coupled to the mechanical support and to the MV sensing device, said fire control unit having a processor for calculating the barrel elevation and traverse in dependence upon at least one input parameter including a default MV for a given ammunition can of projectiles and a measured MV of projectiles that are fired from said weapon.

12. The weapon station of claim 11, wherein said ammunition can of projectiles includes a linked chain of projectiles.

13. The weapon station defined in claim 11, wherein said fire control processor is operative to calculate a new setting for the weapon barrel elevation after the MV of an initially fired projectile is measured, thereby to improve the aiming fidelity of the weapon for second and subsequent shots.

14. The weapon station defined in claim 11, wherein said fire control processor is further operative to calculate a new setting of the weapon barrel elevation after the MV of each further projectile volley is measured, thereby to produce finer adjustments in the barrel elevation and thus continuously improve aiming precision for subsequent volleys.

15. The weapon station defined in claim 11, wherein said ammunition projectiles are conventional point-detonating projectiles.

16. The weapon station defined in claim 11, wherein said ammunition projectiles are programmable air-burst projectiles.

17. The weapon station defined in claim 11, wherein said ammunition projectiles are programmable air-burst projectiles; wherein said fire control processor is operative to calculate a new setting of the weapon barrel elevation after the MV of each projectile volley is measured; and wherein the fire control processor is operative to record a histogram of projectile MV's, and to use said histogram to produce continuously improving elevation precision for subsequent volleys.

18. The weapon station defined in claim 11, wherein said ammunition projectiles are programmable air-burst projectiles; said weapon station comprising means for generating and transmitting a programming signal to fired projectiles in dependence upon their measured MV, thereby to improve the time-of-flight or burst accuracy of second and subsequent projectile volleys.

19. The weapon station defined in claim 11, wherein said ammunition projectiles are programmable air-burst projectiles and wherein said fire control processor adjusts the weapon barrel elevation for a terrestrial target to detonate said projectiles in the range of 1-3 meters above said desired target.

20. An apparatus, including a weapon having a barrel with a muzzle capable of firing ammunition projectiles, said apparatus comprising:

hand-held binoculars and a range finder for determining range to a target;

a mechanical support for the weapon configured to allow elevation and traverse of the weapon barrel;

a sensing device, disposed in or adjacent the weapon barrel, for measuring an exit muzzle velocity (MV) of a fired ammunition projectile;

a fire control unit, electronically coupled to hand-held binoculars and range finder and to the MV sensing device, having a fire control processor calculating a barrel elevation in dependence a range to the target and a measured muzzle exit velocity (MV) of a projectile fired from the weapon.

21. Apparatus as defined in claim 20, wherein said fire control processor is operative to calculate a new setting of the barrel elevation after the MV of an initial projectile volley is measured, thereby to improve the aiming fidelity of the weapon.

22. Apparatus as defined in claim 20, wherein said fire control processor is further operative to calculate a new setting of the barrel elevation after the MV of each further projectile volley is measured, thereby to produce ever finer adjustments in the barrel elevation and thus continuously improve aiming precision for subsequent volleys.

23. Apparatus as defined in claim 20, wherein said ammunition projectiles are point-detonating projectiles.

24. Apparatus as defined in claim 20, wherein said ammunition projectiles are programmable air-burst projectiles.

25. Apparatus as defined in claim 20, the fire control unit controls electronically coupled hand-held binoculars and a range finder, wherein said ammunition projectiles are programmable air-burst projectiles; wherein said fire control processor is further operative to calculate a new setting of the weapon barrel elevation after the MV of each further projectile volley is measured and to record a histogram of projectile MV's, and wherein the fire control processor uses said recorded histogram to produce continuously improving elevation precision so that the emitted time of flight or burst or distance programming signal improves the burst accuracy of second and subsequent projectile volleys.

26. Apparatus as defined in claim 20, wherein said fire control processor adjusts the weapon barrel elevation for a terrestrial target to detonate in the range of 1-3 meters above said target.

* * * * *